US007003990B2

(12) United States Patent
Iliuk

(10) Patent No.: US 7,003,990 B2
(45) Date of Patent: Feb. 28, 2006

(54) MORTICE LOCK

(75) Inventor: Andrey Iliuk, Ashburton (AU)

(73) Assignee: Gainsborough Hardware Industries Limited, Blackburn (AU)

( * ) Notice: Subject to any disclaimer, the term of this patent is extended or adjusted under 35 U.S.C. 154(b) by 0 days.

(21) Appl. No.: 10/744,483

(22) Filed: Dec. 23, 2003

(65) Prior Publication Data

US 2004/0163431 A1 Aug. 26, 2004

Related U.S. Application Data

(63) Continuation of application No. PCT/AU02/00849, filed on Jun. 28, 2002.

(30) Foreign Application Priority Data

Jun. 29, 2001 (AU) ..... PR6046

(51) Int. Cl.
*E05B 59/00* (2006.01)

(52) U.S. Cl. ..... 70/107; 70/149; 70/157; 292/34; 292/165; 292/332

(58) Field of Classification Search ..... 70/107, 70/108–111, 150, 143, 149, 141, 144, 157; 292/34, 36, 40, 39, 165, 336.3, 336.5
See application file for complete search history.

(56) References Cited

U.S. PATENT DOCUMENTS 3,672,714 A * 6/1972 Schultz ..... 292/34
3,808,849 A * 5/1974 Alexander ..... 70/149
4,118,056 A * 10/1978 Alexander ..... 292/169.17
4,276,760 A * 7/1981 Nolin ..... 70/107
4,286,812 A * 9/1981 Sprekeler ..... 292/245
4,389,061 A * 6/1983 Foshee ..... 292/169.14
4,418,552 A * 12/1983 Nolin ..... 70/107
4,589,691 A * 5/1986 Foshee et al. ..... 292/165
4,674,776 A * 6/1987 James ..... 292/40
4,950,005 A * 8/1990 Cudd ..... 292/150
5,027,625 A * 7/1991 Krachten ..... 70/107
5,077,992 A * 1/1992 Su ..... 70/107
5,765,410 A * 6/1998 Kwan et al. ..... 70/107
5,813,255 A * 9/1998 Tell et al. ..... 70/107
5,820,177 A * 10/1998 Moon ..... 292/335
5,878,605 A 3/1999 Renz
5,992,195 A * 11/1999 Huang et al. ..... 70/472

(Continued)

FOREIGN PATENT DOCUMENTS

AU 86226/82 2/1983

(Continued)

*Primary Examiner*—Suzanne Dino Barrett
(74) *Attorney, Agent, or Firm*—MacMillan, Sobanski & Todd, LLC

(57) ABSTRACT

A mortice lock for recessed installation into the edge of a door or door frame includes a deadlatching member that is mounted on a bolt assembly for pivoting movement. A drive shaft and hub can be rotated in either a clockwise or counterclockwise direction to cause bolt retraction. The drive shaft and hub can be locked against rotation, or not, by a lock that is mechanically connected to a cylinder cam rotated by a key. The drive shaft and hub can be locked against rotation, or not, by a lock that is mechanically connected to an assembly including the bolt assembly interacting with a separately activated kick off member such that on retraction of the bolt, depending on the position of the kick off member, the hub is locked against rotation. The bolt can be retracted by each of the key cylinder cam and the hub, in isolation.

32 Claims, 31 Drawing Sheets

U.S. PATENT DOCUMENTS

| | | | | |
|---|---|---|---|---|
| 6,131,966 | A * | 10/2000 | Hensley et al. | 292/139 |
| 6,266,981 | B1 * | 7/2001 | von Resch et al. | 70/107 |
| 6,327,881 | B1 * | 12/2001 | Grundler et al. | 70/107 |
| 6,349,982 | B1 * | 2/2002 | Fayngersh et al. | 292/165 |
| 6,389,855 | B1 * | 5/2002 | Renz et al. | 70/107 |
| 6,393,878 | B1 * | 5/2002 | Fayngersh et al. | 70/107 |
| 6,502,435 | B1 * | 1/2003 | Watts et al. | 70/95 |
| 6,578,888 | B1 * | 6/2003 | Fayngersh et al. | 292/332 |
| 2003/0019257 | A1 * | 1/2003 | Simon et al. | 70/224 |
| 2004/0017087 | A1 * | 1/2004 | Ayres et al. | 292/165 |

FOREIGN PATENT DOCUMENTS

| | | |
|---|---|---|
| AU | 33183/97 | 4/1998 |
| AU | 95153/98 | 2/1999 |
| AU | 14873/00 | 8/2000 |
| AU | 14815/00 | 11/2000 |
| AU | 53643/00 | 3/2001 |
| AU | 71955/00 | 6/2001 |
| BE | 877785 | 11/1979 |
| CA | 2292203 | 6/2000 |
| DE | 36 30 747 | 3/1988 |
| DE | 297 03 320 | 5/1997 |
| DE | 196 07 578 | 9/1997 |
| EP | 352495 | 1/1990 |
| FR | 2452561 | 10/1980 |
| FR | 2753225 | 3/1998 |
| GB | 2271380 | 4/1994 |

* cited by examiner

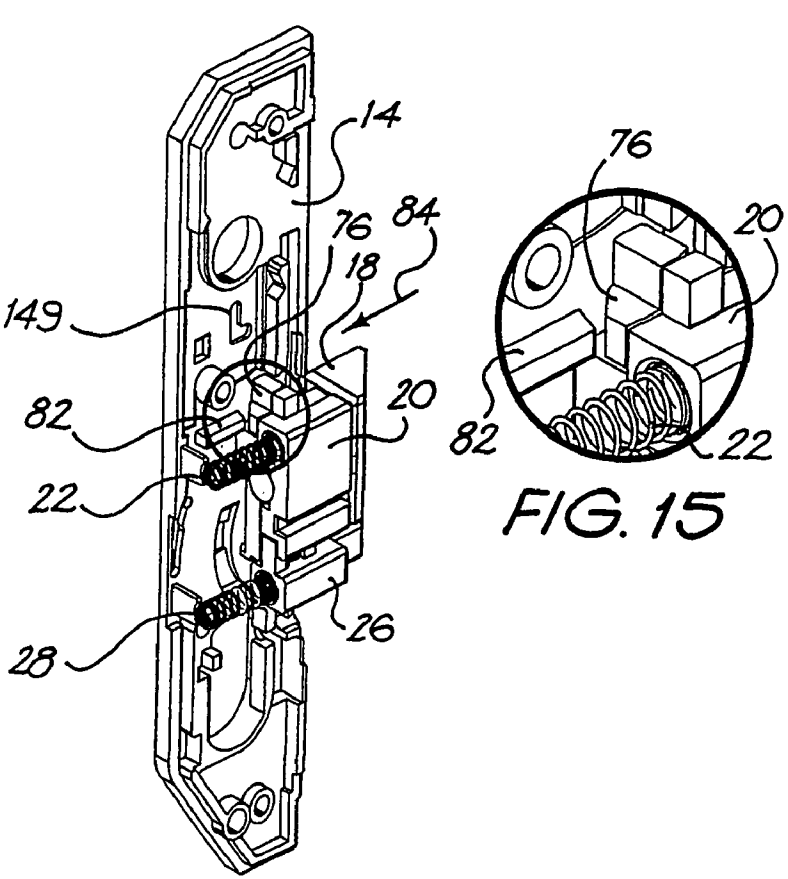
FIG. 14
FIG. 15
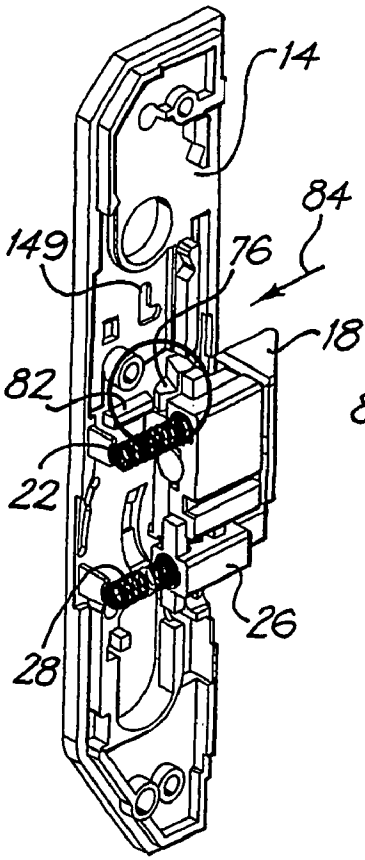
FIG. 12
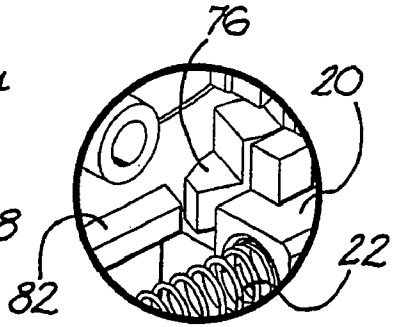
FIG. 13

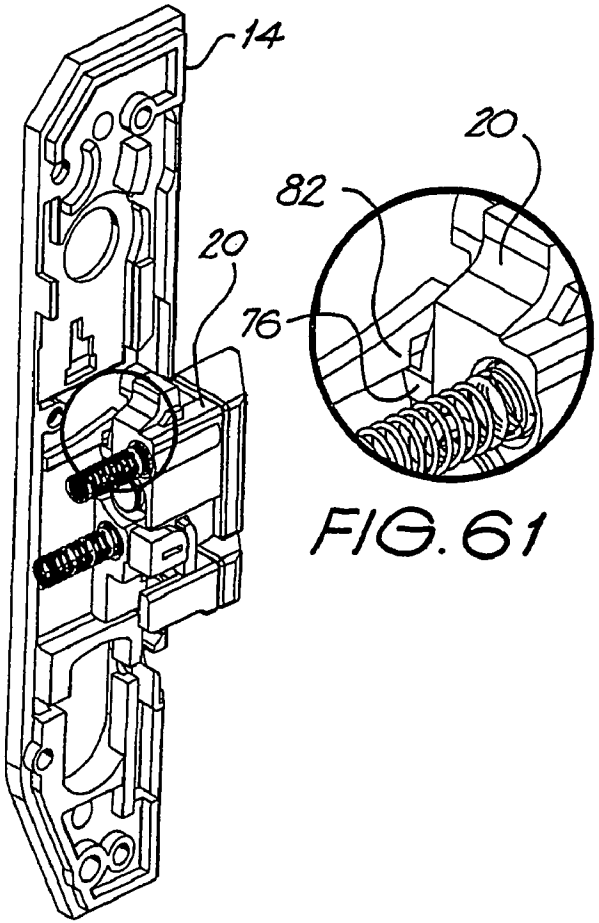
FIG. 60
FIG. 61
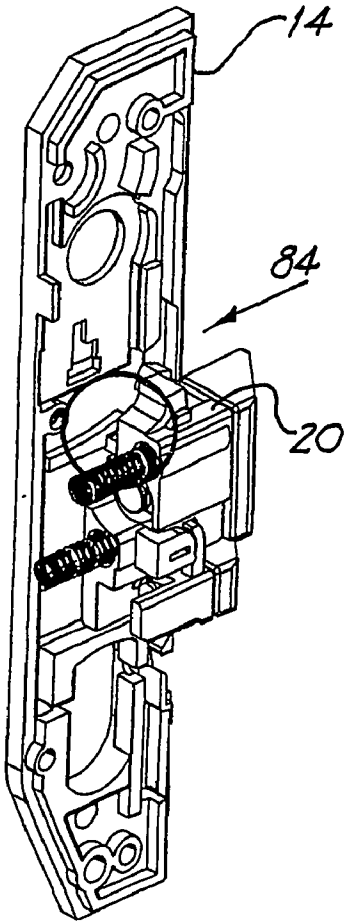
FIG. 58
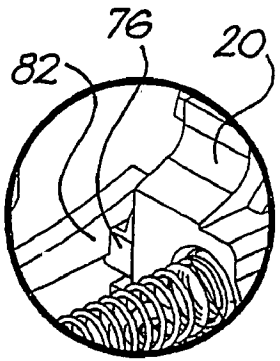
FIG. 59

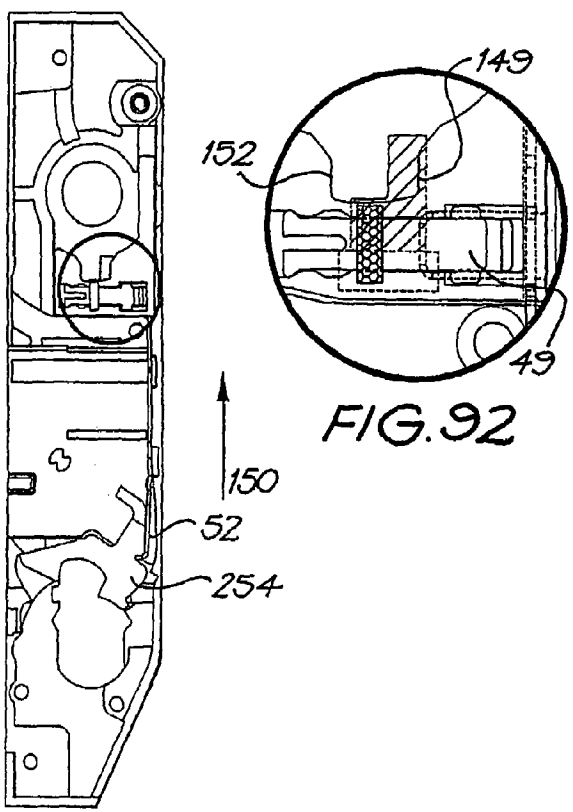
FIG. 92
FIG. 91
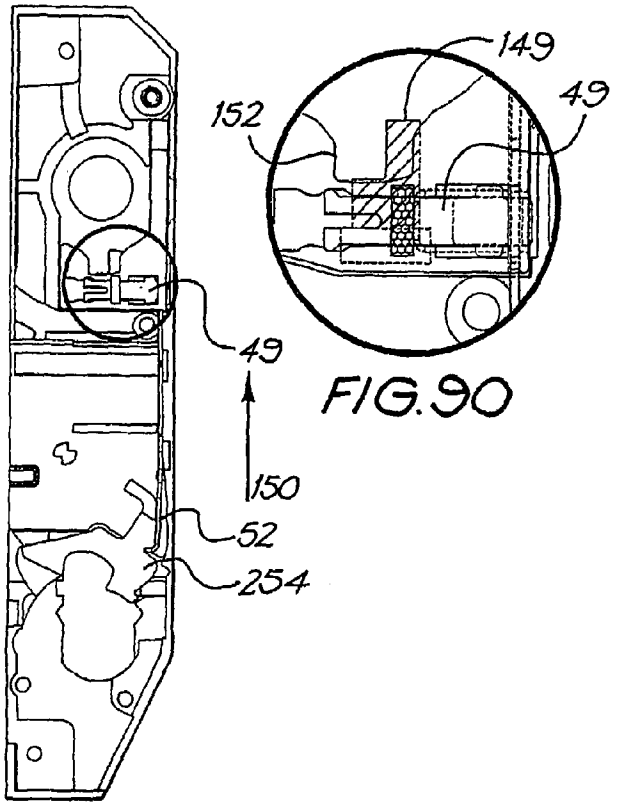
FIG. 90
FIG. 89

MORTICE LOCK

CROSS REFERENCE TO RELATED APPLICATION

This application is a continuation of International Application No. PCT/AU02/00849, filed Jun. 28, 2002, which claims priority from Australian Patent Application No. PR6046, filed Jun. 29, 2001. The disclosures of both applications are incorporated herein by reference.

FIELD OF THE INVENTION

The present invention relates to a lock and more particularly to a mortice lock which is adapted for recessed installation into the edge of a door or door frame.

The invention has been primarily developed for installation in the aluminium frame of a glass sliding door and will be described with reference to this application. However, it would be appreciated that the invention is not limited to this particular application and is equally suited for installation in other types of doors.

BACKGROUND OF THE INVENTION

Numerous types of mortice locks are known. A problem common to most known mortice locks is their inability to be easily re-configured to suit different door backset distances. This requires different models of each lock for each backset distance, which adds to development and inventory cost.

Another problem is a lack of space efficiency of the internal components. Compactness is vital, especially for short backset distances.

Further, many known mortice locks can only operate in one handle turning direction, which causes operational problems with knobs, as they tend to be used in both directions.

Some mortice locks have the locking cylinder above the handle. This results in keys scratching the handle. Also, the large opening in the housing where the cylinder is fitted, allows sawdust and other debris to fall in to the lock mechanism and cause mechanical failure.

OBJECT OF THE INVENTION

It is an object of the present invention to substantially overcome or at least ameliorate one or more of the above disadvantages and, in general, to provide a mortice lock with fewer components than known mortice locks

SUMMARY OF THE INVENTION

Accordingly, in a first aspect, the present invention provides a mortice lock comprising:

a lock housing;

a bolt assembly adapted to move relative to the housing along a working direction between extended position and retracted positions;

a deadlatching member adapted to pivot between a deadlatching position preventing the bolt assembly from moving from the extended position to the retracted position and an closing position allowing the bolt assembly to move from the extended position to the retracted position;

wherein the deadlatching member is pivotally mounted on the bolt assembly for movement with the bolt assembly and adapted to pivot between said deadlatching and closing positions in a direction normal to the working direction.

The deadlatching member is preferably spring biased to the deadlatching position.

The bolt assembly is preferably spring biased to the extended position.

The lock housing preferably has a protuberance and, when in the closing position, the deadlatching member is adapted to travel with the bolt assembly past the protuberance and, when in the deadlatching position, the deadlatching member is adapted to travel with the bolt assembly into abutment with the protuberance.

The bolt assembly preferably includes a primary bolt and an auxiliary bolt and the deadlatching member is driven between the closing and deadlatching positions by relative movement between the primary bolt and the auxiliary bolt.

In an embodiment, the bolt assembly preferably also includes a bolt carrier to which: the primary bolt is rotationally mounted, the deadlatching member is pivotally mounted; and the auxiliary bolt is slidably mounted. The deadlatching member preferably includes a first protuberance adapted to abut the auxiliary bolt, whereby slidable movement of the auxiliary bolt relative to the primary bolt causes pivotal movement of the deadlatching member.

In another embodiment, the bolt assembly also includes a bolt carrier assembly to which: the primary bolt is rotationally mounted; the deadlatching member is pivotally mounted; and an auxiliary bolt assembly is slidably mounted. The deadlatching member preferably includes a protuberance adapted to abut the auxiliary bolt assembly, whereby slidable movement of the auxiliary bolt assembly relative to the primary bolt carrier causes pivotal movement of the deadlatching member. The auxiliary bolt assembly preferably includes the auxiliary bolt and an auxiliary bolt carrier.

The lock preferably also includes a drive shaft adapted to be driven about an axis by a handle or knob and a member adapted to pivot in response to rotation of said drive shaft, whereby initial pivotal movement of the member causes pivotal movement of the deadlatching member to the closing position and further pivotal movement of the arm causes sliding movement of the bolt assembly to the retracted position.

In a second aspect, the present invention provides a mortice lock comprising:

a lock housing;

a drive shaft adapted to be rotationally driven about an axis by a handle or knob;

a hub mounted on the shaft for rotation therewith from a first position towards either a second clockwise position and a third anti-clockwise position, the hub having a pair of spaced apart protuberances; and a drive means adapted for movement relative to the housing, the drive means having a pair of formations and an engaging surface adapted, upon moving, to cause movement in a bolt retraction assembly, wherein clockwise movement of the hub to the second position causes one of the protuberances to abut one of the formations and cause the drive member to move in a first direction and anti-clockwise movement of the hub to the third position causes the other of the protuberances to abut the other of the formations and also cause the drive member to move in the first direction.

In one form, the drive means is mounted for slidable movement relative to the housing.

In another form, the drive means is mounted for pivotal movement relative to the housing and incorporates the bolt retraction assembly therein.

The bolt retraction assembly is preferably moved to retract the bolt regardless of which direction (clockwise or anti-clockwise) the handle or knob is rotated.

The drive means is desirably spring biased in a second direction opposite the first direction and also biases the hub to the first position.

The lock desirably includes a pair of the drive shafts and a pair of the hubs, each mounted on one of the drive shafts, and the drive means contains two pairs of formations, wherein each one of the pairs of formations is adapted to engage each one of the pairs of protuberances when the hubs are in the first position.

In an embodiment, the bolt retraction assembly includes a pivotable latch arm and the drive member engaging surface is a gear rack adapted to engage with a gear portion provided on the latch arm.

In another embodiment, the bolt retraction assembly is an arm pivotally mounted to the lock housing.

In a third aspect, the present invention provides a mortice lock comprising:

a lock housing;

a drive shaft adapted to be rotationally driven about an axis by a handle or knob;

a hub mounted on the shaft for rotation therewith, the hub having a protuberance; and a hub rotation locking means having a recess and adapted for slidable movement relative to the housing between a first position in which the protuberance is received within the recess and the hub is thus prevented from rotating and a second position in which the protuberance is remote the recess and the hub is thus able to rotate;

a locking device adapted for slidable movement relative to the housing in response to rotation of a cylinder cam;

an engagement means settable in a engaged position in which the hub rotation locking means and the locking device are joined for slidable movement together relative to the housing and an disengaged position in which the hub rotation locking means and the locking device are free from slidable movement together relative to the housing, wherein, when the hub locking means is in the second position and said engagement means is set in said engaged position, rotation of the cylinder cam in a first direction slides the locking device and the hub rotation locking means together such that the protuberance is received in the recess and the hub is not able to rotate and, when the hub locking means is in the second position and said engagement means is set in the disengaged position, rotation of the cylinder cam in said first direction slides the locking device only such that the protuberance remains remote from the recess and the hub is able to rotate.

Preferably, when the hub locking means is in the first position and the engagement means is set in the engaged position, rotation of the cylinder cam in a second direction opposite to the first direction slides the locking device and the hub rotation locking means together such that the protuberance is remote from the recess and the hub is able to rotate.

Preferably also, the engagement means travels between the engaged and disengaged positions in a direction normal to the direction of travel of the locking device.

The engagement means preferably includes an end that is received with an opening in the locking device in the engaged position and that is remote the opening in the disengaged position.

In one form, the engagement means is biased to remain in one of the engaged or disengaged positions by a detent.

In another form, the engagement means is biased to remain in one of the engaged or disengaged positions by spring legs.

The lock desirably includes a pair of the drive shafts and a pair of the hubs, each mounted on one of the drive shafts, and a pair of the engagement means, wherein each of the engagement means are independently settable with respect to the locking device.

In a fourth aspect, the present invention provides a mortice lock comprising:

a lock housing;

a bolt assembly adapted to move relative to the housing between extended and retracted positions, the bolt assembly having a first driving protuberance;

a kick off actuation member mounted for pivotal movement between an active position and an inactive position, the kick off member having a second driving protuberance;

a hub mounted on a drive shaft for rotation therewith; and a locking device adapted for slidable movement relative to the housing between a locking position preventing rotation of the hub and an unlocking position allowing rotation of the hub;

wherein when the kick off member is in the inactive position and the bolt assembly is driven from the extended position towards the retracted position, the first driving protuberance passes the second driving protuberance without contact therebetween and causes no movement of the kick off member from the inactive position, and wherein when the kick off member is in the active position and the bolt assembly is driven from the extended position towards the retracted position, the first driving protuberance contacts the second driving protuberance and causes initial pivotal movement of the kick off member to the active position and further pivotal movement of the kick off member in the same direction causing the locking device to be driven to the locking position.

The kick off member is preferably biased to remain in one of the active or inactive positions by a detent.

In one form, the kick off member is pivotally mounted to the casing.

In another form, the kick off member is pivotally mounted to the bolt assembly.

The lock housing preferably includes an aperture through which a tool end may pass into engagement with the kick off member to allow movement of the kick off member between the active or inactive positions.

In a fifth aspect, the present invention provides a mortice lock comprising:

a lock housing;

a bolt assembly adapted to move relative to the housing between extended and retracted positions;

a key cylinder cam adapted to be driven by a key or tab;

a drive shaft adapted to be driven by a handle or knob;

a hub mounted on the shaft for movement therewith; and a bolt retraction assembly adapted to withdraw the bolt from the extended position to the retracted position in response to movement of each of the key cylinder cam and the hub, in isolation.

BRIEF DESCRIPTION OF THE DRAWINGS

A preferred embodiment of the invention will now be described, by way of an example only, with reference to the accompanying drawings in which:

FIG. 12 is a partial perspective view of the lock shown in FIG. 1 and the bolt assembly shown in FIG. 5 after door closure;

FIG. 13 is an enlarged detailed view of the components shown in FIG. 12;

FIG. 14 is a partial perspective view of the lock shown in FIG. 1 and the bolt assembly shown in FIG. 5 before door closure;

FIG. 15 is an enlarged detail view of the components shown in FIG. 14;

FIG. 58 is a partial perspective view of the lock shown in FIG. 49 and the bolt assembly shown in FIG. 53 after door closure;

FIG. 59 is an enlarged detailed view of the components shown in FIG. 58;

FIG. 60 is a partial perspective view of the lock shown in FIG. 49 and the bolt assembly shown in FIG. 53 before door closure;

FIG. 61 is an enlarged detailed view of the components shown in FIG. 60;

FIG. 89 is a partial side view of the lock shown in FIG. 49 showing the locking bar engager engaged to the locking bar and disengaged from the lock housing;

FIG. 90 is an enlarged detail view of FIG. 89;

FIG. 91 is a partial side view of the lock shown in FIG. 49 showing the locking bar engager disengaged from the locking bar and engaged to the lock housing; and FIG. 92 is an enlarged detail view of FIG. 91.

DETAILED DESCRIPTION OF THE PREFERRED EMBODIMENTS

Figures 1, 2:
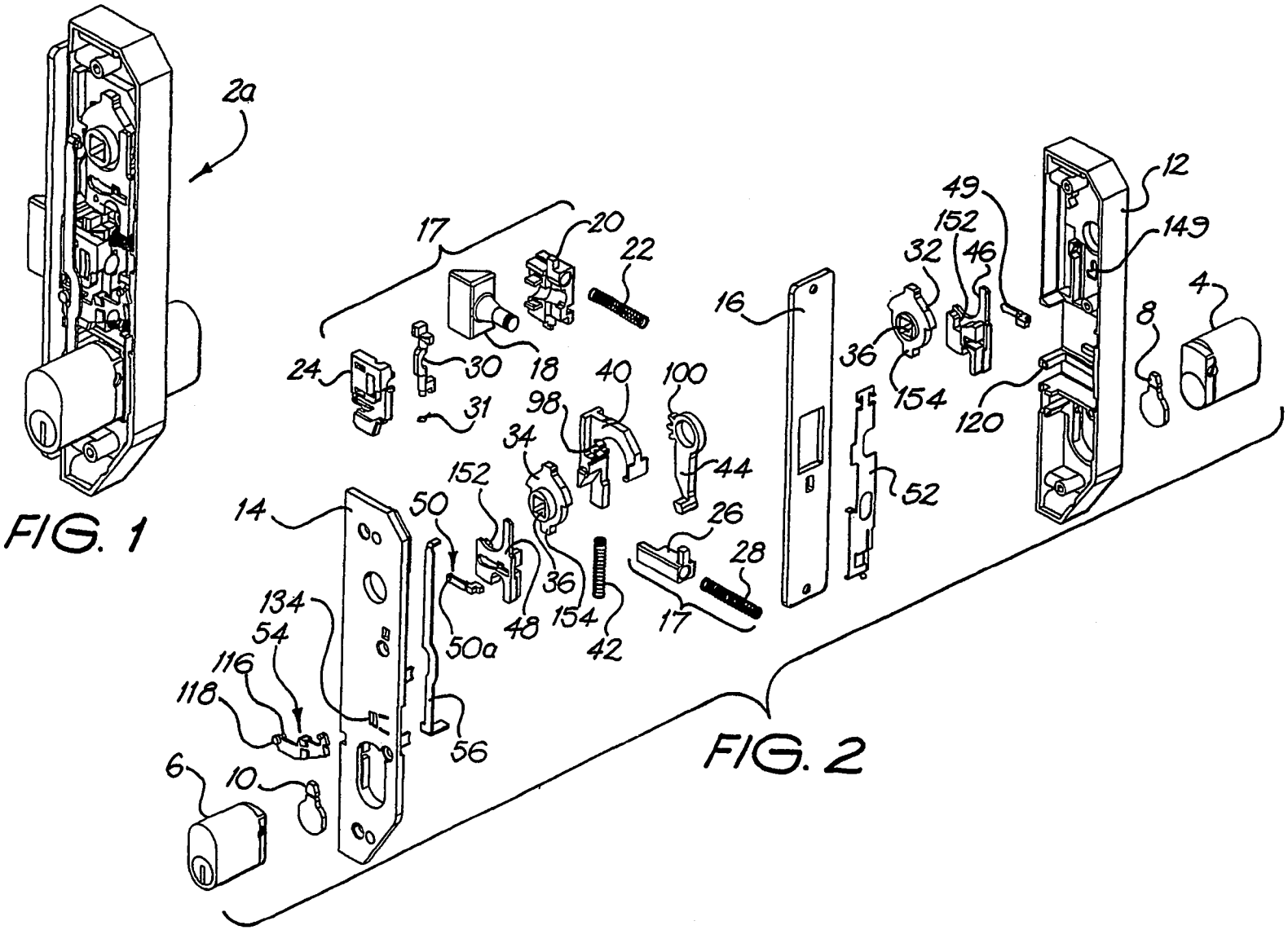
FIG. 1 is a rear partial perspective view of an assembled mortice lock according to a is first embodiment of the invention.
FIG. 2 is an exploded view of the lock shown in FIG. 1 in the orientation of FIG. 1.
Figures 3, 4:
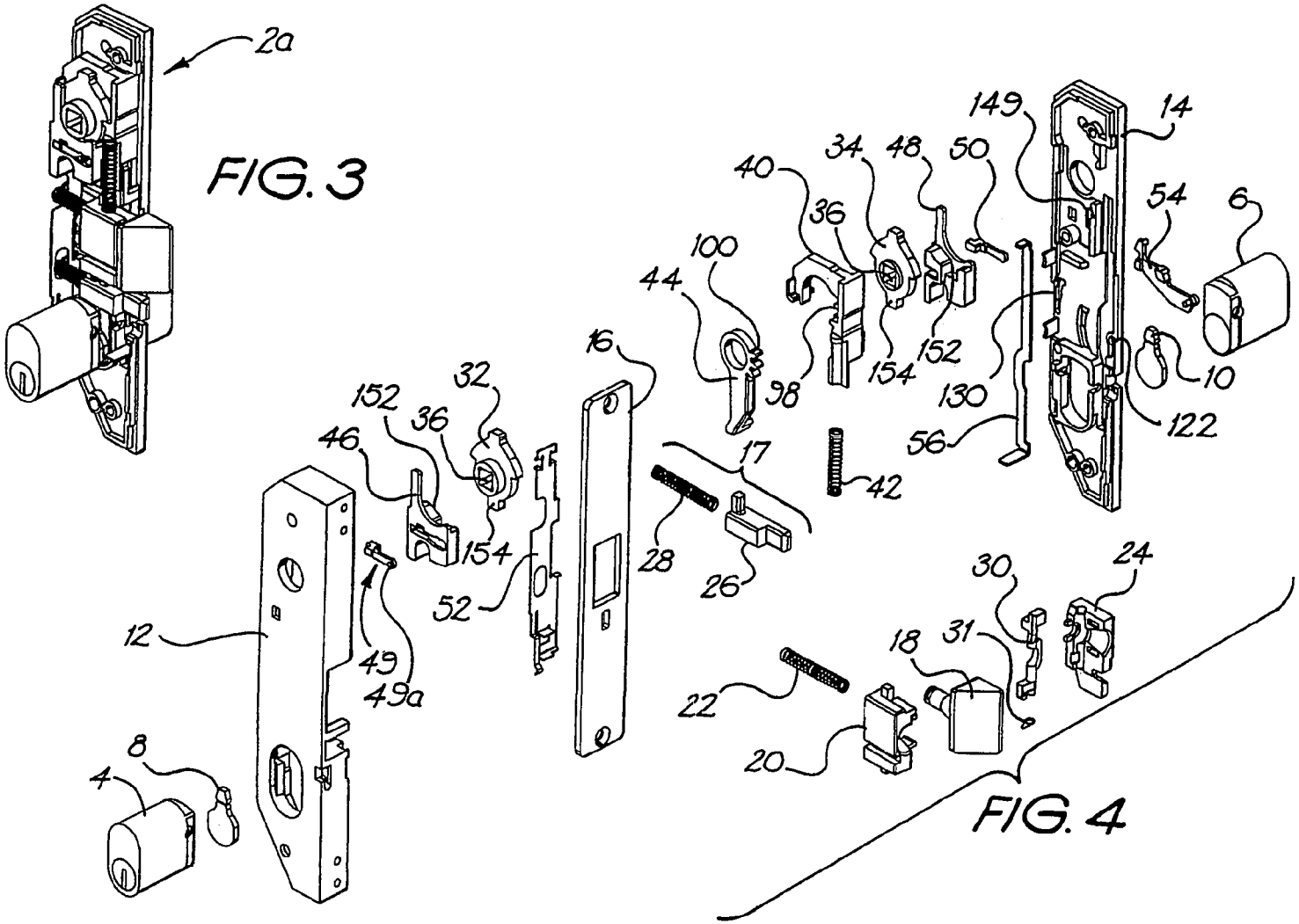
FIG. 3 is a front partial perspective view of the lock shown in FIG. 1.
FIG. 4 is an exploded perspective view of the lock shown in FIG. 1 in the orientation of FIG. 3.
Figure 6:
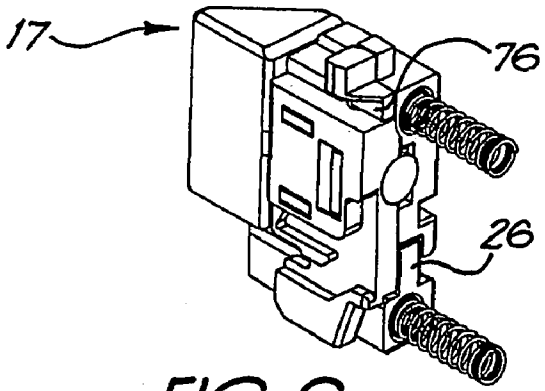
FIGS. 6 and 7 are assembled rear perspective views of the bolt assembly shown in FIG. 5 before and after door closure.
Figure 7:
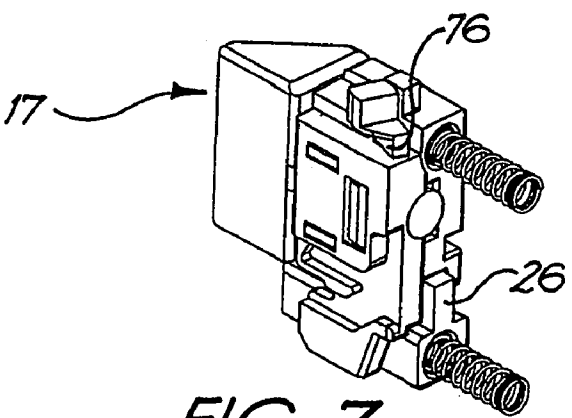

FIGS. 1 to 48 show a first embodiment of a mortice lock 2*a* which includes examples of the five aspects of the invention. Turning firstly to FIGS. 1 to 4, the lock 2*a* includes first and second key cylinders 4 and 6 that each have associated cams 8 and 10. The first key cylinder 4 is mounted to a lock housing 12 and the second key cylinder 6 is mounted to a lock housing cover 14. A fore-end plate 16 is also mounted to the lock housing 12.

The lock 2*a* includes a bolt assembly 17 comprised of a latch bolt 18, a bolt carrier 20 with an associated bolt spring 22, a bolt carrier retaining insert 24 and an auxiliary bolt 26 with an associated auxiliary bolt spring 28. A deadlatching member, in the form of deadlatching rocker arm 30, is pivotally mounted to the bolt assembly 17, more particularly between the bolt carrier 20 and the bolt carrier retaining insert 24 as will be described in more detail below. The rocker arm 30 has an associated torsion spring 31.

The lock 2*a* also includes external handles, such as knobs or levers (not shown), which are connected to a pair of conventional square cross section drive shafts (not shown) which are in turn connected to first and second hubs 32 and 34. More particularly, each of the hubs 32, 34 has a corresponding square cross section aperture 36 for non rotationally engaging one of each of the drive shafts to transmit rotational movement from one of the handles to an associated one of the hubs 32, 34.

The lock 2*c* also includes a drive means, in the form of a drive rack 40 and associated drive rack spring 42, and a bolt retraction assembly, that includes a latch bolt retraction arm 44, as will also be described in more detail below.

The lock 2*a* also includes a pair of hub rotation locking means, in the form of first and second hub locking sliders 46 and 48, that each have an associated engagement means, in the form of first and second locking bar engagers 49 and 50. The locking bar engagers 49, 50 can each be set in one of two positions in which an associated hub locking slider 46 and 48 respectively does, or does not, travel with movement of a locking bar 52, as will also be described in more detail below.

The lock 2*a* also includes a kick off actuation member, in the form of kick off lever 54, and a cylinder cam bolt retraction bar 56, the operation of which will also be described in more detail below.

Figure 5:
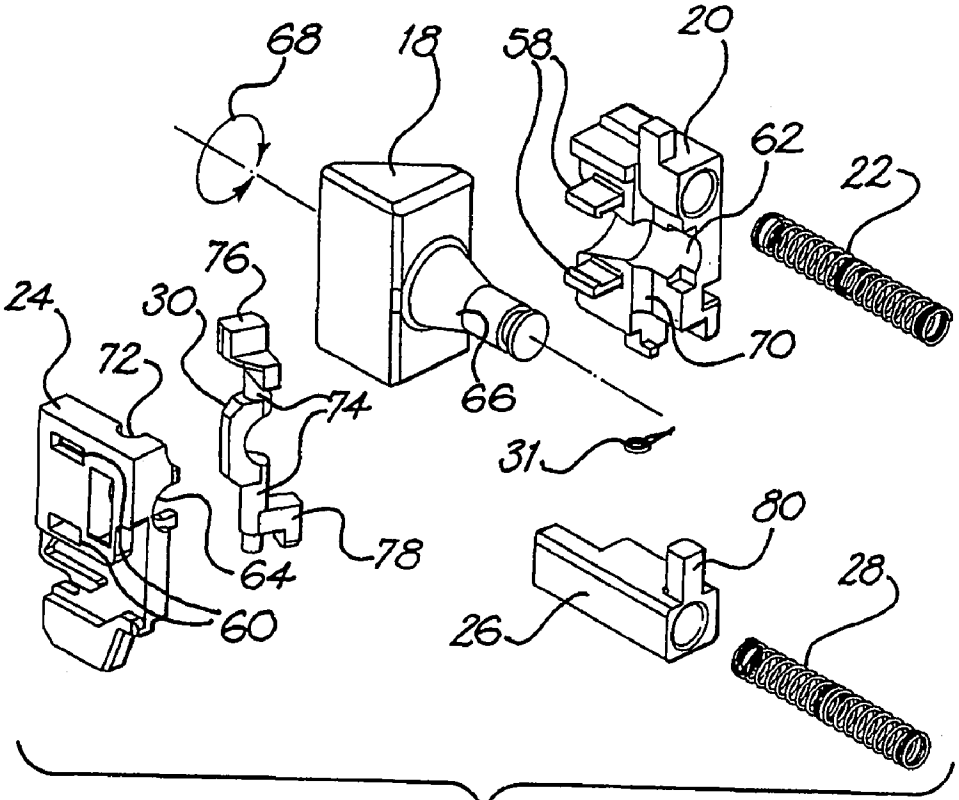
FIG. 5 is an exploded perspective view of a bolt assembly from the lock of FIG. 1.
Figure 10:
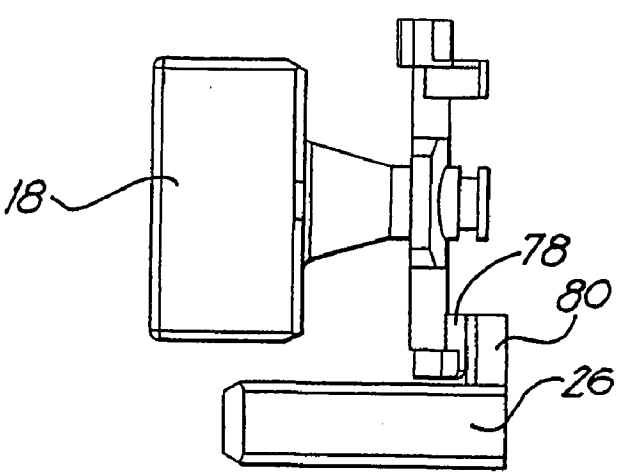
FIGS. 10 and 11 are partial side and top views of the bolt assembly shown in FIG. 7.
Figure 11:
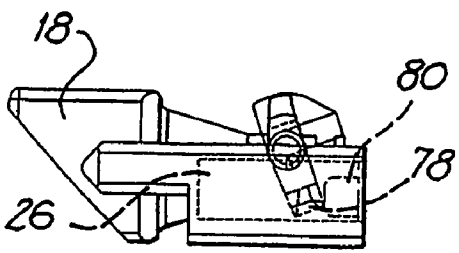
Figure 8:
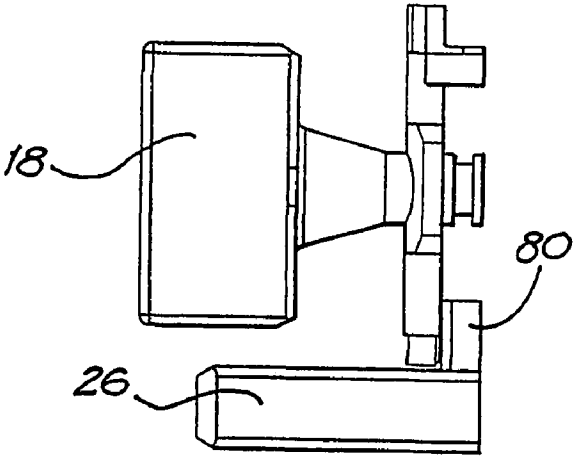
FIGS. 8 and 9 are partial side and top views respectively of the bolt assembly shown in FIG. 6.
Figure 9:
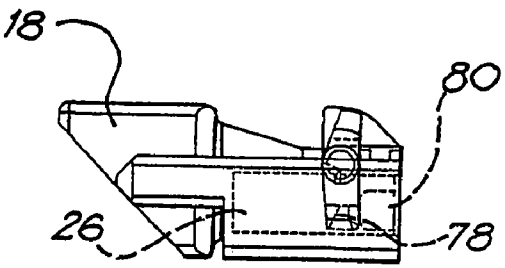

The features and operation of the deadlatching assembly will now be described in more detail with reference to FIGS. 5 to 17. As best seen in FIG. 5, the bolt carrier 20 and the bolt carrier retaining insert 24 are assembled by snap-engaging prongs 58 with corresponding recesses 60. Each of the carrier 20 and the insert 24 include a partial tapered cylindrical recess 62 and 64 which correspond to, and receive therein, a similarly tapered shaft 66 extending from the latch bolt 18. This allows the latch bolt 18 to be rotated about its longitudinal axis, as indicated by the doubled headed arrow 68, for easy re-handing of the lock 2*a*. The carrier 20 and the insert 24 also have other partial cylindrical recesses 70 and 72 which correspond to cylindrical portions 74 on the deadlatching rocker arm 30. This allows the rocker arm 30 to pivot between a deadlatching position (see FIGS. 7, 10, 11, 12 and 13) and an opening position (see FIGS. 6, 8, 9, 14 and 15). The rocker arm 30 is biased to the deadlatching position by the torsion spring 31. The rocker arm 30 also has first and second eccentric end protuberances 76 and 78 respectively. The protuberance 78 operatively engages with a protuberance 80 on the auxiliary bolt 26.

FIGS. 12 and 13 show the latch bolt 18 in an extended position, as would occur after closure of a door. During a slam door closing action (ie. door closure without prior bolt retraction), the bolt 18 initially retracts as it travels over a strikeplate (not shown) and then extends under the influence of the spring 22 into the latch bolt opening present in a conventional strikeplate. As the stikeplate does not have an opening that corresponds to the auxiliary bolt 26, the auxiliary bolt 26 is not able to extend as far as the latch bolt 18 when the door is closed. This results in the protuberance 80 not abutting, and thus not causing pivotable movement of, the second end protuberance 78 of the rocker arm 30, as described above. The rocker arm 30 therefore pivots under the influence of the spring 31 until its other end protuberance 76 has pivotted to the position shown in FIGS. 12 and 13. As best shown in FIG. 13, when the rocker arm 30 is in this position, the first end protuberance 76 will abut a boss 82 on the cover plate 14 when the bolt 18 is attempted to be forced back into the housing 12, in the direction of arrow 84. Such movement of the bolt 18 is as would be experienced if an illegal opening of the lock 2*a* was attempted. This abutment 82 stops the latch bolt 18 from being retracted and thus stops the door from being opened.

FIGS. 14 and 15 show the lock 2*a* before door closure. As the auxiliary bolt 26 is able to extend to the same extent as the latch bolt 18, the protuberance 80 abuts, and causes pivotable movement of, the second end protuberance 78 of the rocker arm 30 against the influence of the spring 31. This pivotable movement of the rocker arm 30 causes its other end protuberance 76 to pivot to the position shown in FIGS. 14 and 15. As best shown in FIG. 15, when the rocker arm 30 is in this position the first end protuberance 76 clears the boss 82 on the cover plate 14 as the bolt 18 is forced back into the housing 12, in the direction of arrow 84, as would be experienced during a slam door closure.

Figure 17:
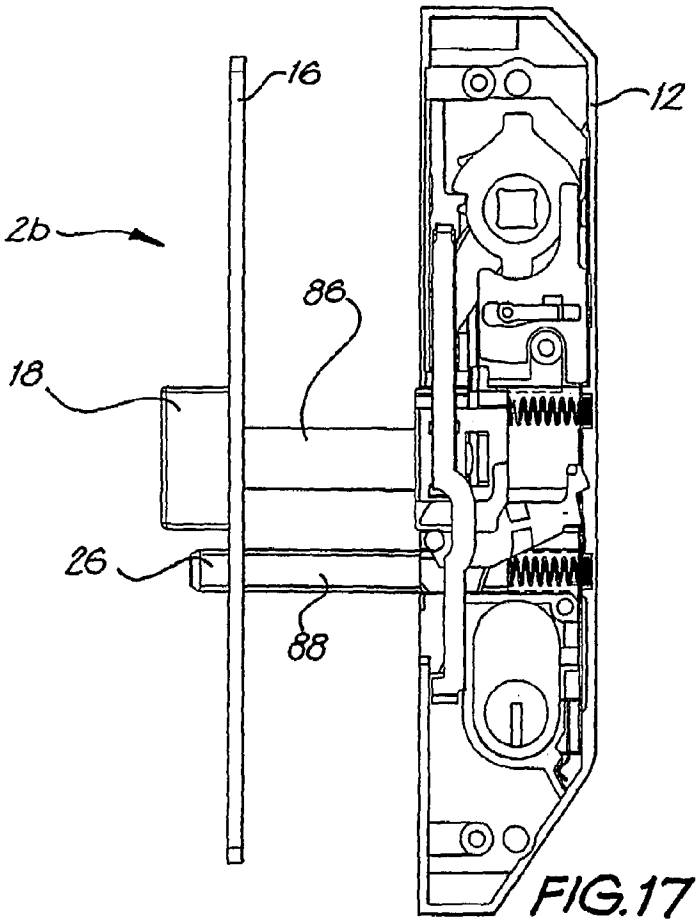
FIG. 17 is a modified form of the bolt assembly shown in FIG. 16 with a 60 millimetre backset.
Figure 16:
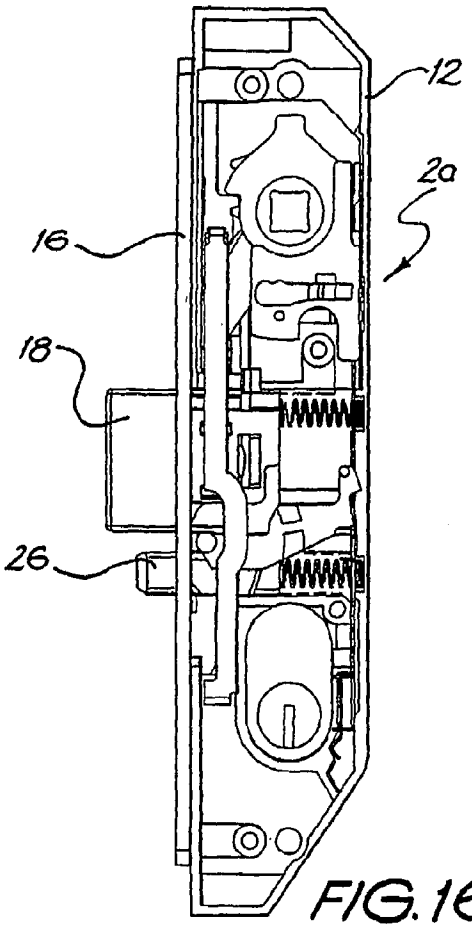
FIG. 16 is a side view of the bolt assembly shown in FIG. 1 with a 23 millimetre backset.

The primary advantage of the deadlatching rocker arm 30 being pivotally mounted to the bolt assembly 17 is best described with reference to FIGS. 16 and 17. FIG. 16 shows the lock 2*a* configured for a (standard) 23 millimetre backset (backset being the distance between the outside of the cover plate and the centre line of the hubs/actuation shafts). A 23 millimetre backset is suitable for an aluminium framed door. FIG. 17 shows an almost identical lock 2*b* configured for use with a (standard) 60 millimetre backset, which is suitable for a standard timber door. Importantly, such a change can be simply achieved by the addition of two very simple extension pieces 86 and 88 to the bolt 18 and the auxiliary bolt 26 respectively, and the addition of a spacer block (not shown) to the housing 12. Alternatively, longer versions (not shown) of the bolt 18 and auxiliary bolt 26 can be substituted. Also, larger versions (not shown) of the housing 12 and the cover 14 can be used to obviate the need for the spacer block. All other components of the lock 2*b* remain unmodified. Accordingly, the lock 2*a* can be easily configured for many different backsets with only very minimal componentry changes, thereby obviating the need for specific lock designs for specific applications and reducing development and inventory costs.

Figure 20:
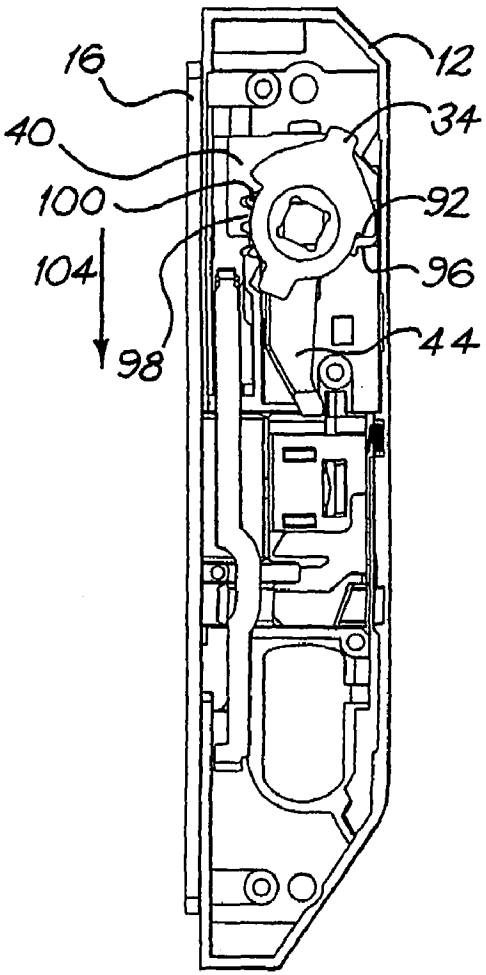
FIGS. 18, 19 and 20 are side views of the lock shown in FIG. 1 with the hub in first, second and third positions respectively.
Figure 19:
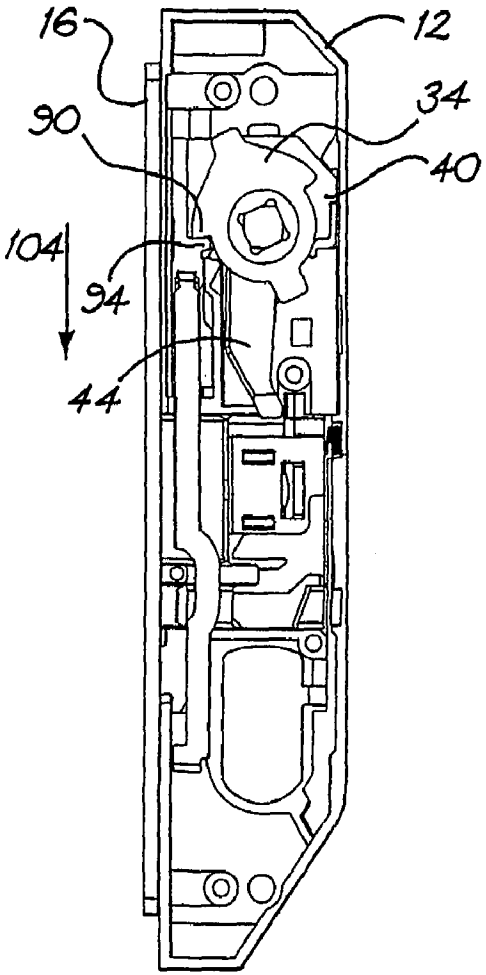
Figure 18:
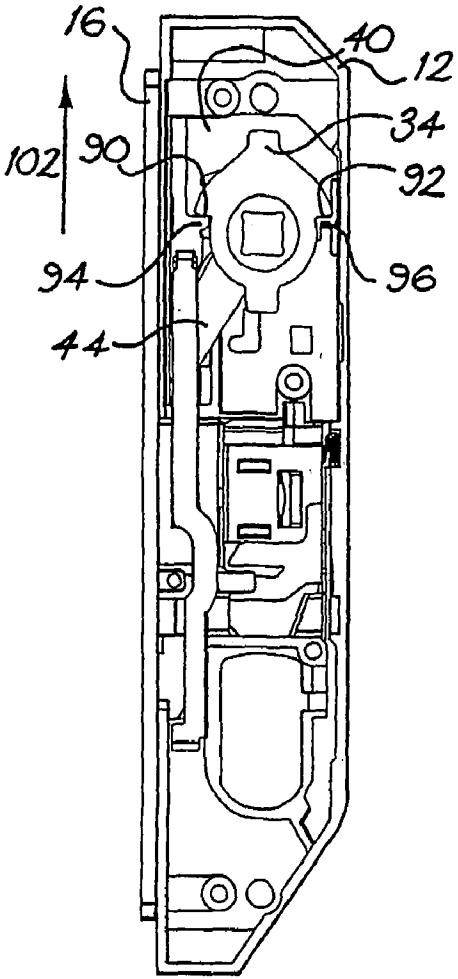
Figure 24:
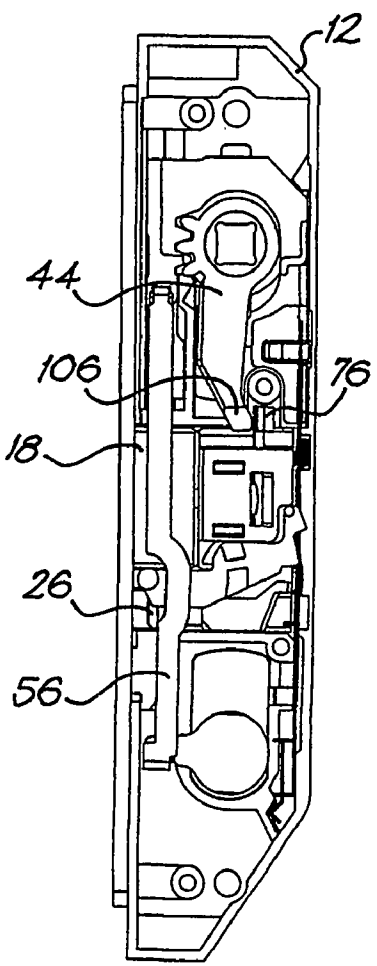
FIGS. 23 and 24 are perspective views and side views respectively of the lock shown in FIG. 1 with the bolt retracted.

Also advantageous is that the bolt 18 in the lock 2*a* is able to be retracted, for door opening, by rotation of either exterior handle in either direction, as will now be described with reference to FIGS. 18 to 28. As best seen in FIGS. 18 to 20, the hub 34 has a pair of protuberances, in the form of angularly spaced apart shoulders 90 and 92, and the drive rack 40 has a pair of formations, in the form of corresponding ledges 94 and 96. The drive rack 40 also has an engaging surface, in the form of gear rack 98 (see FIG. 2). The rack 98 engages with pinion gears 100 on the latch bolt retraction arm 44 (see also FIG. 2). The drive rack 40 is biased in the direction of arrow 102 by the spring 42, which in turn biases the hub 34 into the (first) position shown in FIG. 18.

If the exterior handle (not shown) is turned to rotate the hub anti-clockwise, as shown in FIG. 19 the first shoulder 90 engages the first ledge 94 and drives the drive rack 40 in the direction of arrow 104 against the action of the spring 42. As the retraction arm 44 is mounted for pivotable movement only, the (downward) movement of the gear rack 98 on the drive rack 40 causes the latch bolt retraction arm 44 to pivot in an anti-clockwise direction If the exterior handle (not shown) is turned to rotate the hub 34 in a clockwise direction, as shown in FIG. 20 the second shoulder 92 engages the second ledge 96 which also drives the drive rack 40 in the direction of arrow 104 and causes counter-clockwise pivotable movement of the retraction arm 44, as previously described.

Figure 22:
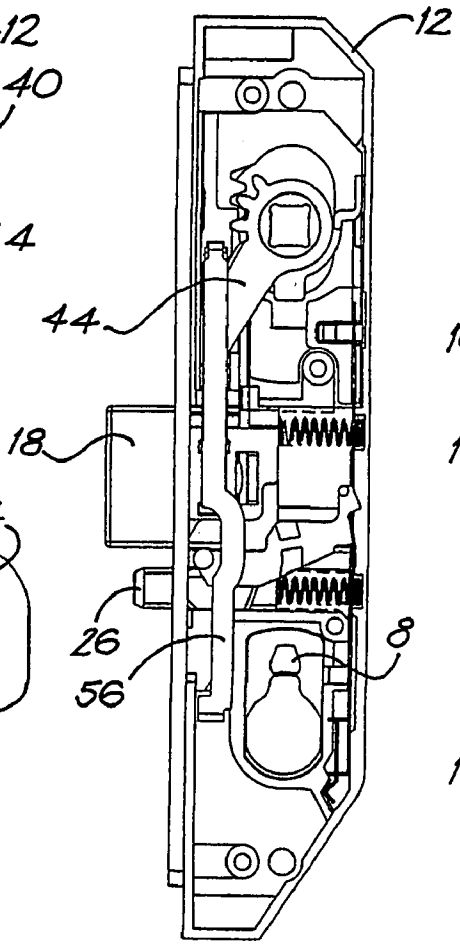
FIGS. 21 and 22 are perspective views and side views respectively of the lock shown in FIG. 1 with the bolt extended.
Figure 21:
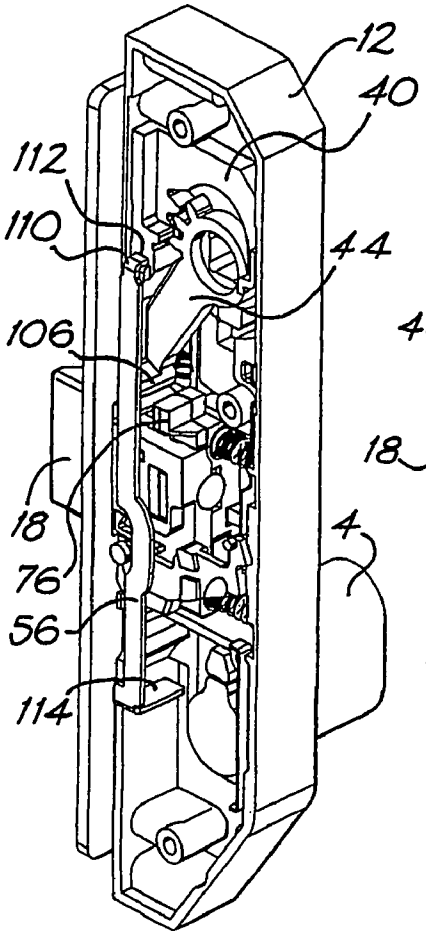
Figure 25:
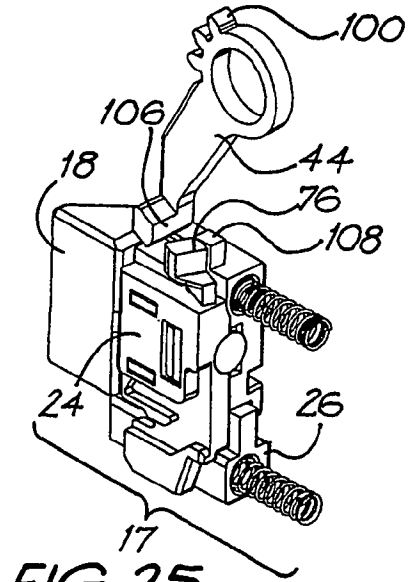
FIGS. 25 and 26 are partial perspective and side views of the bolt assembly and a bolt retraction arm showing the bolt in an extended position.
Figure 26:
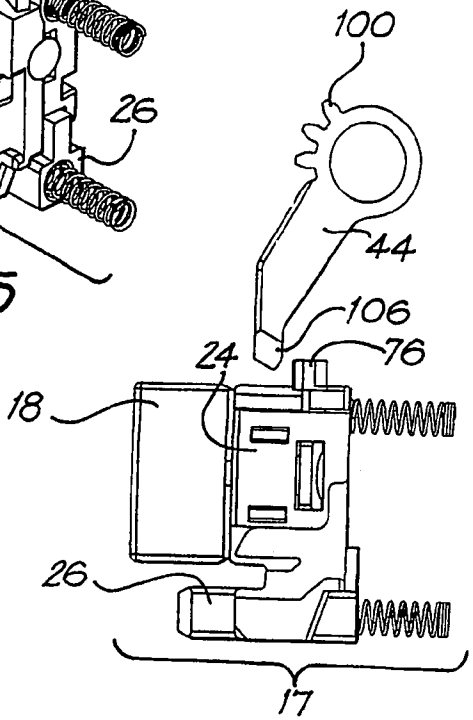
Figure 27:
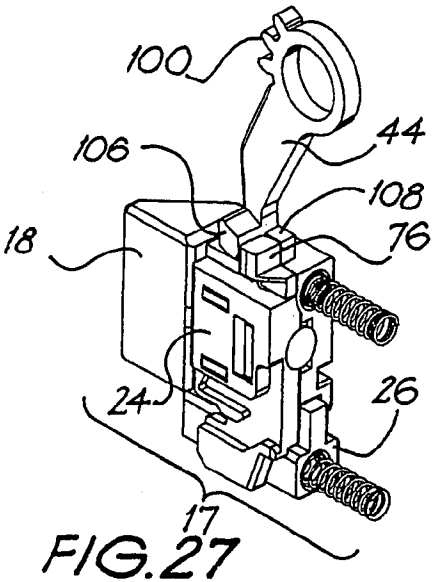
FIGS. 27 and 28 are partial perspective and side views respectively of a bolt assembly and a bolt retraction arm showing the bolt at the start of retraction.
Figure 28:
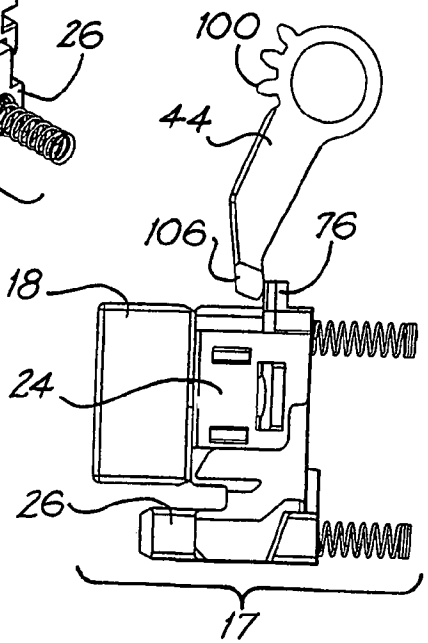
Figure 30:
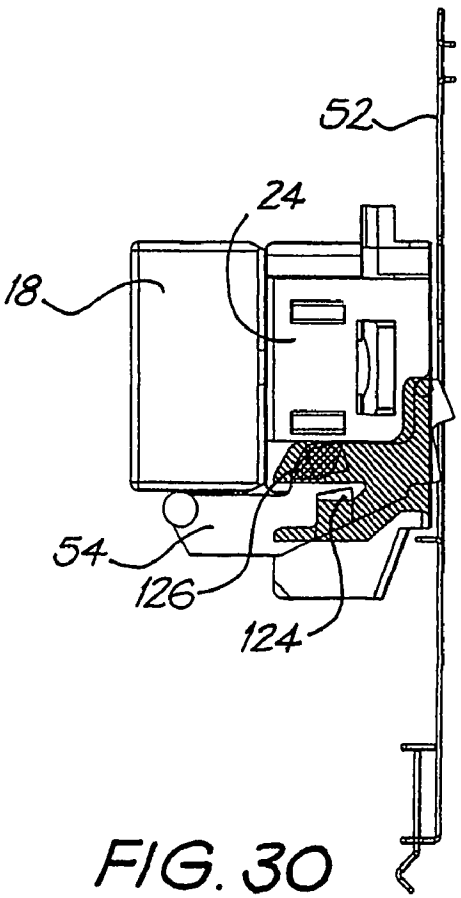
FIGS. 29 to 32 are partial side views of the bolt assembly and a kick off member in various stages of operation.
Figure 29:
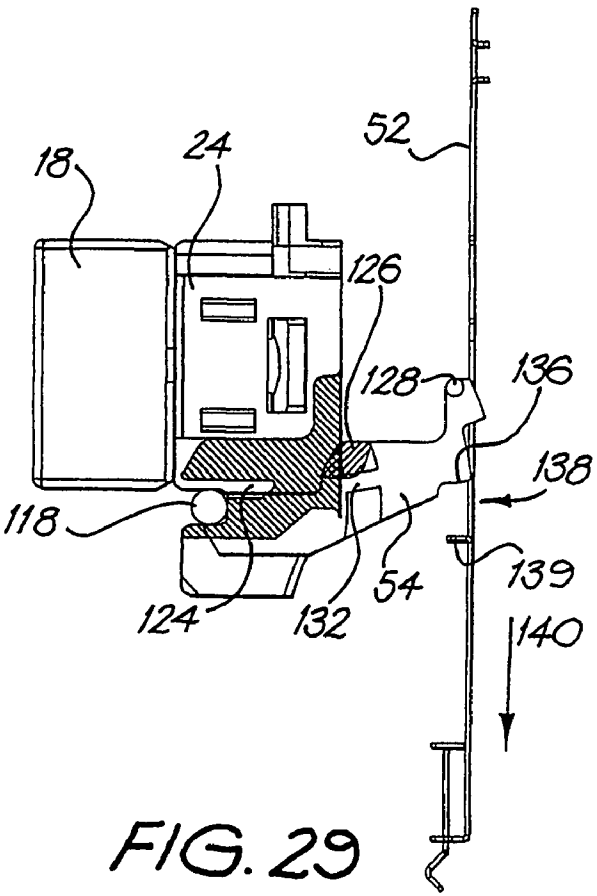
Figure 32:
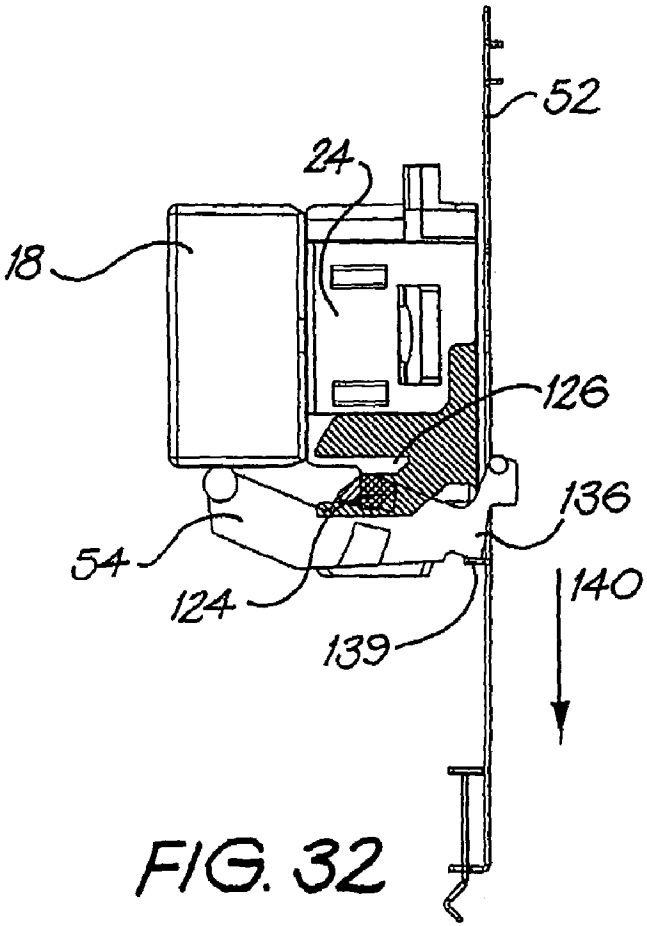
Figure 31:
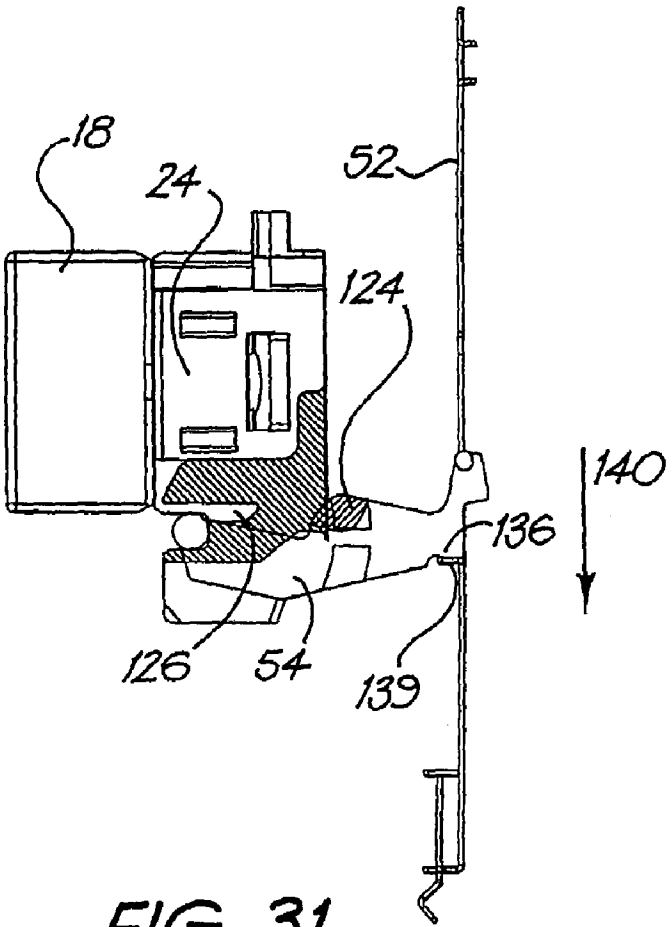
Figure 36:
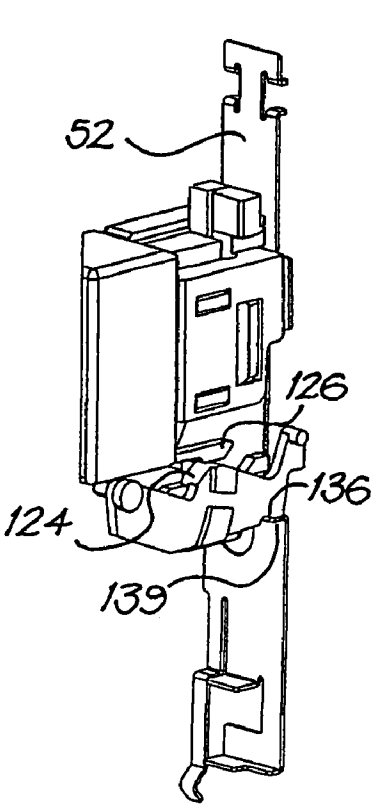
FIGS. 33 to 36 are partial perspective views of the bolt assembly kick off member and locking device in various stages of operation.
Figure 35:
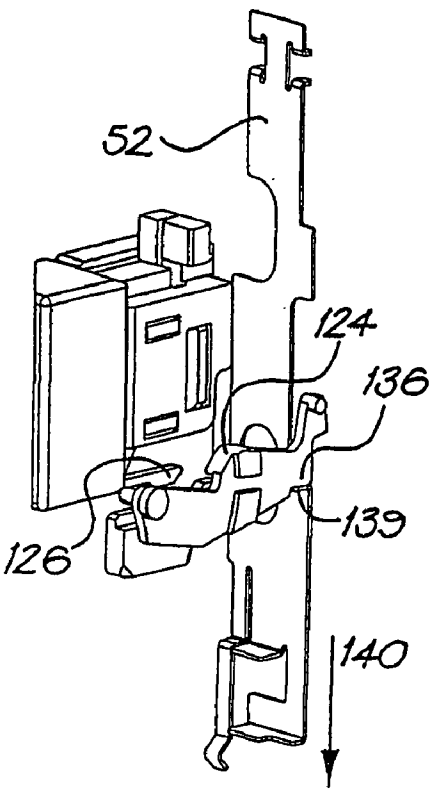
Figure 34:
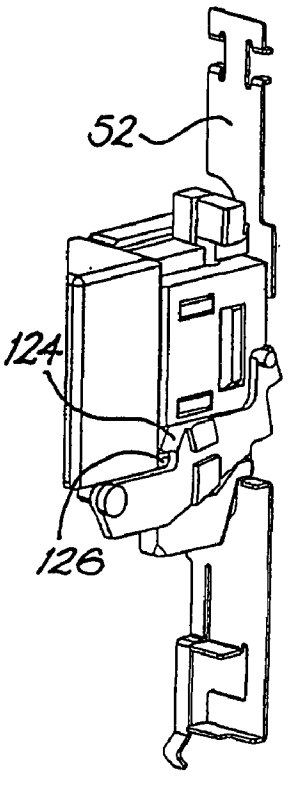
Figure 33:
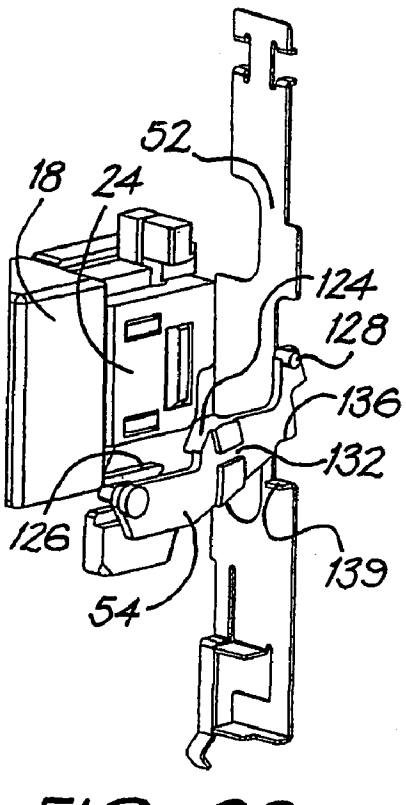
Figure 40:
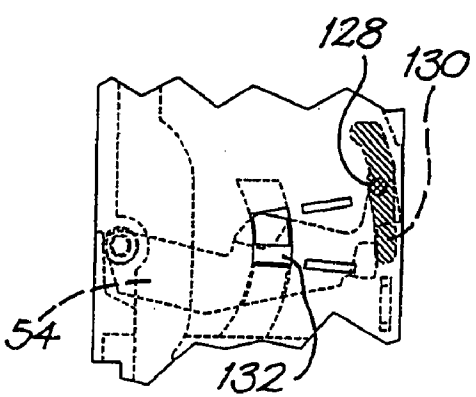
FIG. 40 is an enlarged detailed view of FIG. 37.
Figure 39:
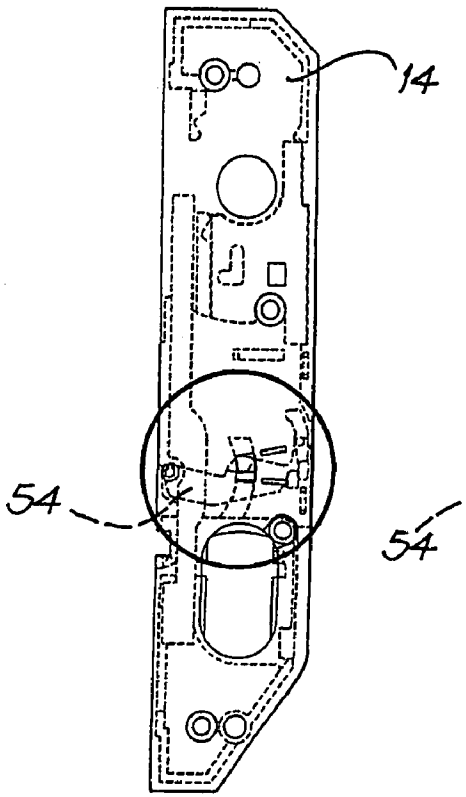
FIG. 39 is a side view of the lock shown in FIG. 1 with the kick off member set in an active position.
Figure 38:
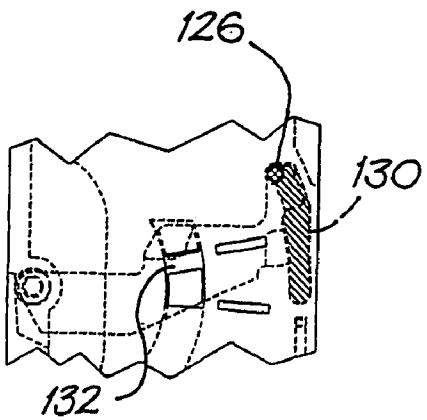
FIG. 38 is an enlarged detailed view of FIG. 37.
Figure 37:
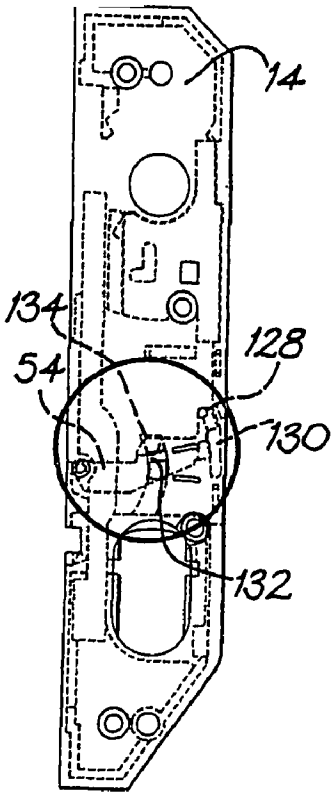
FIG. 37 is a side view of the lock shown in FIG. 1 with the kick off member set in an inactive position.

The retraction of the latch bolt 18 by the latch bolt retraction arm 44 will now be described with reference to FIGS. 21 to 24, which correspond to the partial views shown in FIGS. 25 to 28 respectively. FIGS. 21 and 22 (see also FIGS. 25 and 26) show the latch bolt 18 in an extended position and deadlatched. As has been previously described, the initial pivotable movement of the rocker arm 44 causes its distal end 106 to abut the first end protuberance 76 of the deadlatching rocker arm 30 and drive it from the deadlatching position to the opening position (see FIGS. 23, 24, 27 and 28). As the rocker arm 30 is moved to the opening position, the distal end of the retraction arm 44 also abuts a boss 108 provided on the bolt carrier 20 and further anti-clockwise pivotable movement of the retraction arm 44 retracts the latch bolt 18 into the bolt casing 12 (see FIG. 23 and 24).

It is advantageous for bolt retraction to be achievable with handle rotation in either direction, especially when the actuation handles are knobs. Further, when this handle operation is coupled with the re-handing ability of the latch bolt described above then a single lock is provided that is suitable for use in all installations regardless of inside/outside/left hand opening/right hand opening.

The operation of the cylinder cam bolt retraction bar 56 will also be described with reference to FIGS. 21 to 24. The bar 56 has a first end tab 110 which is received in a slot 112 in the drive rack 40. The other end of the bar 56 has a second end tab 114. The cam 8 of the first key, cylinder 4 abuts the second end tab 114 when initially rotated in an anti-clockwise direction. Further rotation of the cam 8 in the anti-clockwise direction drives the bar 56, and thus the drive rack 40, in the direction of arrow 104. The movement of the drive rack 40 is identical to that caused by rotation of the hub 34, as previously described, and causes the latch bolt retraction arm 44 to similarly retract the bolt 18 for door opening, as also previously described.

The advantages of this arrangement are two-fold. Firstly, when the cams 8 and 10 are used (see FIGS. 2 and 4), regardless if the lock is locked or unlocked a closed door can be operated single handedly (ie. if unlocked—turn only key or turn only handle, if locked—turn only key). However, the cams 8 and 10 can also be shortened so they cause movement of only the locking bar 52 when unlocking or locking the lock 2, thereby is requiring independent movement of the cylinder cam bolt retraction bar 56 to open an unlocked or closed door. Secondly, as the key cylinder cams 8 and 10 act with common componentry to that of the handle, the overall number of components in the lock 2*a* is reduced thereby simplifying manufacture and assembly.

The operation of the kick off lever 54 will now be described in more detail with reference to FIGS. 29 to 40. The kick off lever 54 has small and large stub shafts 116 and 118 respectively on its distal end. The shafts 116, 118 are pivotally received in corresponding recesses 120 (see FIG. 2) and 122 (see FIG. 4) provided in the lock housing 12 and lock housing cover 14 respectively. The lever 54 thus pivots about the shafts 116, 118 with respect to the lock housing 12 and the cover 14. The bolt carrier retaining insert 24 has a drive boss 124 adjacent the lever 54 which itself has a drive boss 126. The lever 54 also has a detent 128, which travels within a slot 130 (see FIG. 4) in the lock housing cover 14, that is biased to either end of the slot 130. The middle of the lever 54 has a raised portion with a slot 132 therein. When assembled, the slot 132 is accessible through an opening 134 (see FIG. 2) in the lock housing cover 14. A screw driver or like tool can be inserted through the opening 134 into the slot 132 and used to position the kick off lever 54 in a (inactive) position in which the detent 128 is held in the top of the slot 130 or a (active) position in which the detent 54 is held lower in the slot 130 (see FIGS. 37 to 40). The distal end of the lever 54 also includes a shoulder 136 which protrudes into a recess 138 in the locking bar 52. The recess 138 has a lower tab 139. The locking bar 52 can be linked for movement with the first and second hub locking sliders 46 and 50 for locking and unlocking the lock 2, as will be described in more detail below. For present purposes it is sufficient to say that driving the locking bar 52 in the direction of arrow 140 can unlock the lock 2.

FIGS. 29, 30, 33 and 34 show the kick off lever 54 in the inactive position. During closure of a door, the bolt 18 rides over the strikeplate and is moved from an extended position (FIGS. 29 and 33) to a retracted position (see FIGS. 30 and 34). During this movement the drive boss 124 on the bolt carrier retaining insert 24 slides beneath the drive boss 126 on the lever 54 without any driving contact being made therebetween. Accordingly, this movement does not affect the position of the kick off lever 54 or the locking bar 52 and, when the kick off lever 54 is in the inactive position, closure of the door will not unlock the door. When the kick off lever 54 is in the active position (FIGS. 31, 32, 35 and 36) then closing of the door as previously described causes the drive boss 124 to abut the lever drive boss 126 and pivot the lever 54 such that the shoulder 136 pivots in the direction of the arrow 140. This causes the shoulder 136 to engage the recess tab 139 and drive the locking bar 52 in the direction of arrow 140, thereby altering the lock 2*a* from locked to unlocked.

Placing the kick off lever 54 in the active position therefore provides a safe guard against inadvertent locking of the door upon closure. An advantage provided by the kick off lever 54 is that it operates in conjunction with a component of the lock used for other purposes (ie. the locking bar) thereby reducing the number of components and the production and assembly cost of the lock overall.

Figure 42:
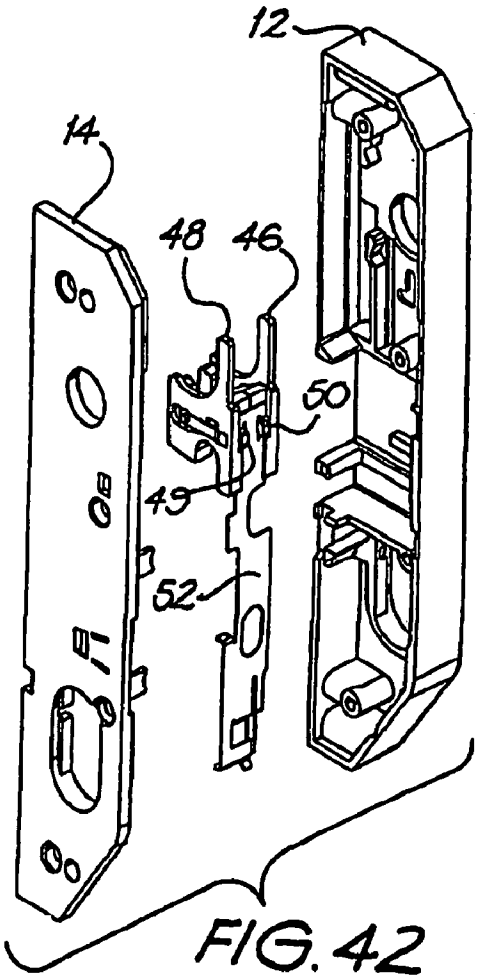
FIG. 42 is a partially assembled exploded view of the components shown in FIG. 41.
Figure 41:
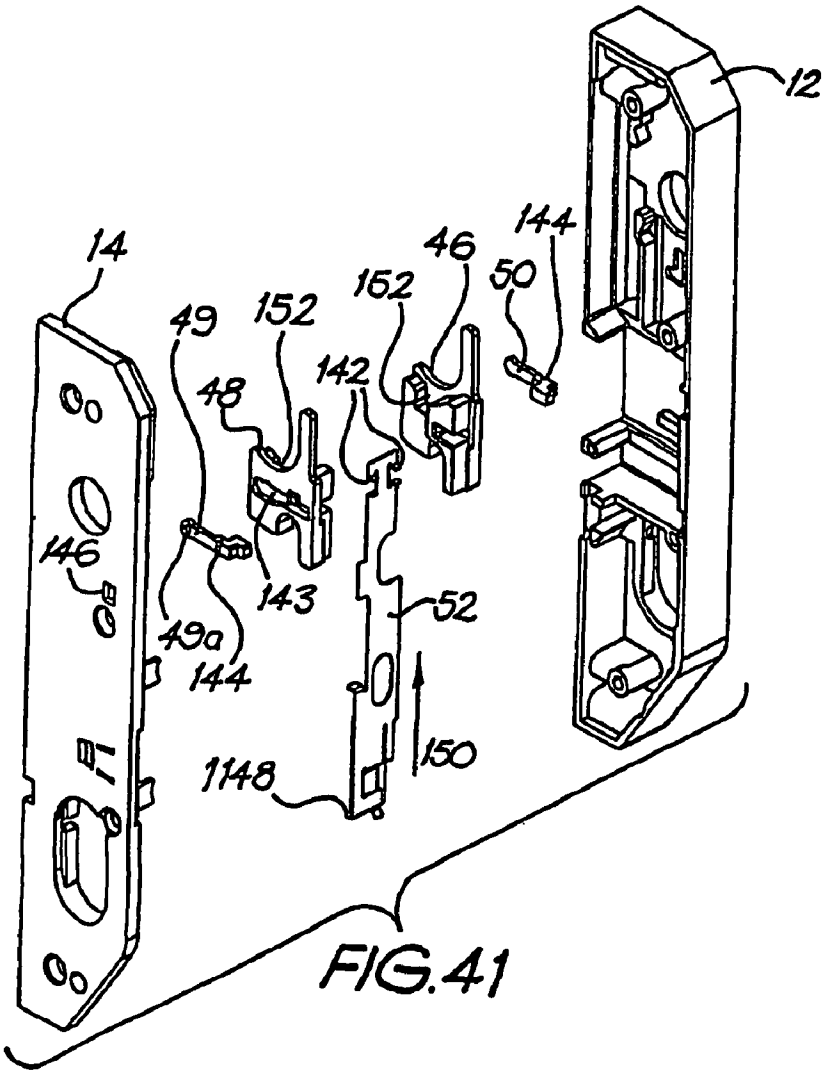
FIG. 41 is an exploded perspective view of the hub locking means of the lock shown in FIG. 1.
Figure 46:
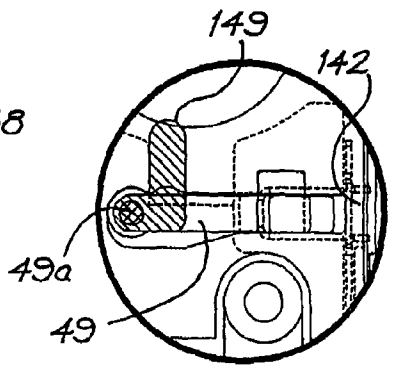
FIG. 46 is an enlarged detailed view of FIG. 45.
Figure 45:
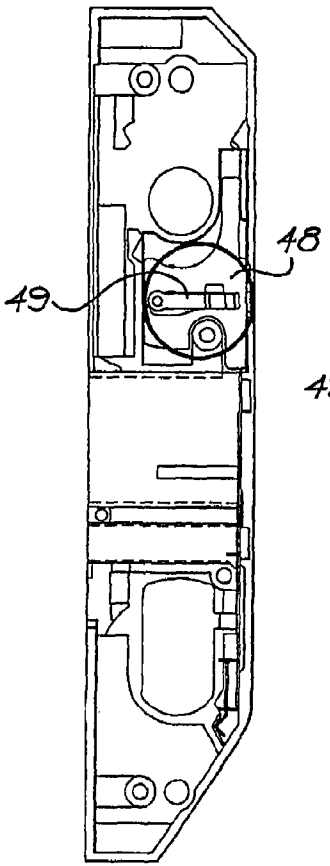
FIG. 45 is a partial side view of the lock shown in FIG. 1 with the engagement means in a disengaged position.
Figure 44:
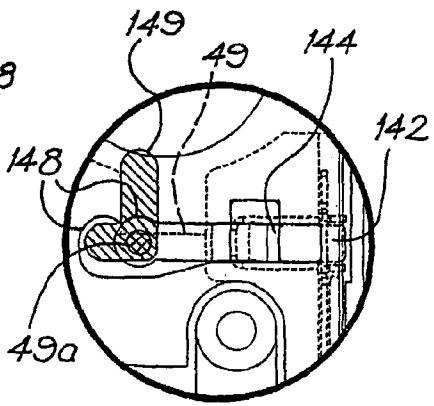
FIG. 44 is an enlarged detailed view of FIG. 43.
Figure 43:
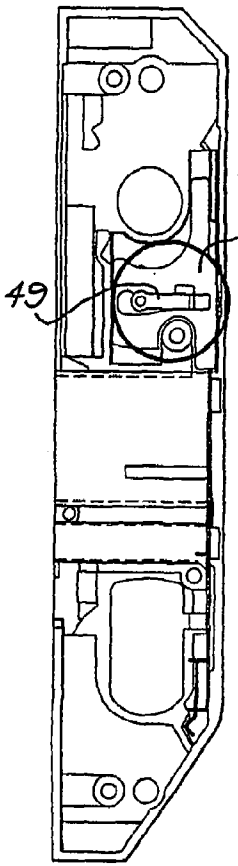
FIG. 43 is a partial side view of the lock shown in FIG. 1 with the engagement means in an engaged position.
Figure 48:
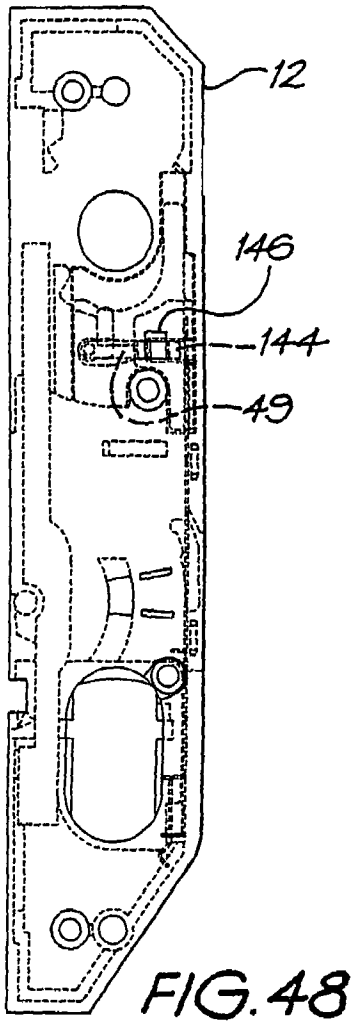
FIG. 48 is a side view of the lock shown in FIG. 45.
Figure 47:
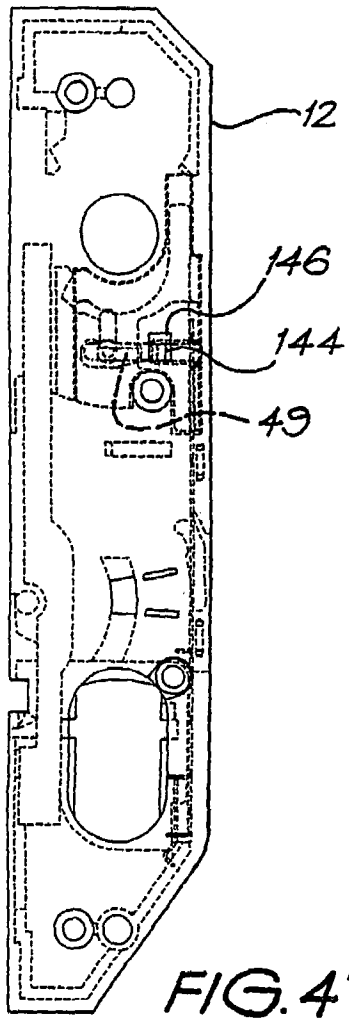
FIG. 47 is a side view of the lock shown in FIG. 43.
Figures 49, 50:
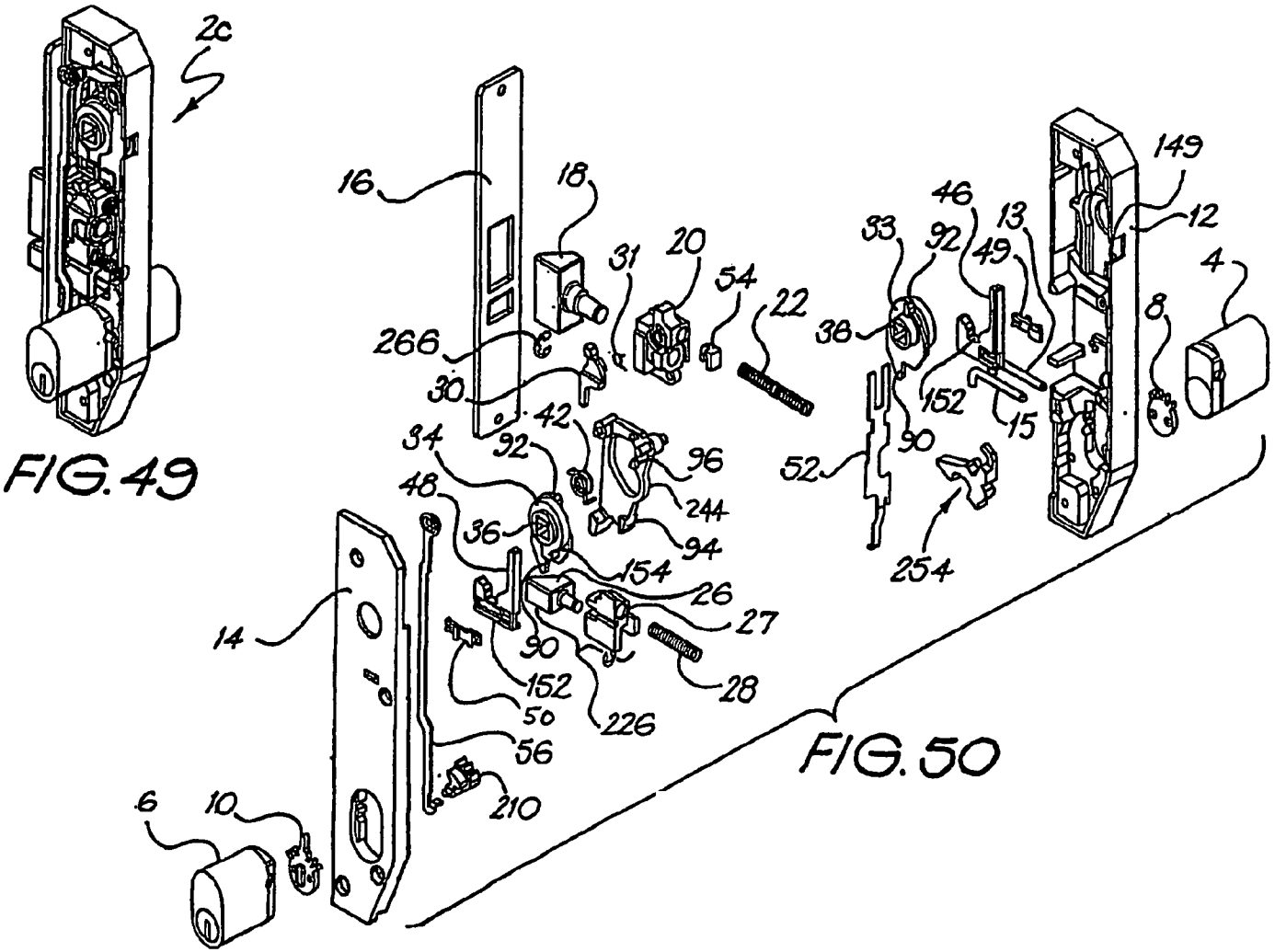
FIG. 49 is a rear partial perspective view of an assembled mortice lock according to a second embodiment of the invention.
FIG. 50 is an exploded view of the lock shown in FIG. 49 in the orientation of FIG. 49.
Figures 51, 52:
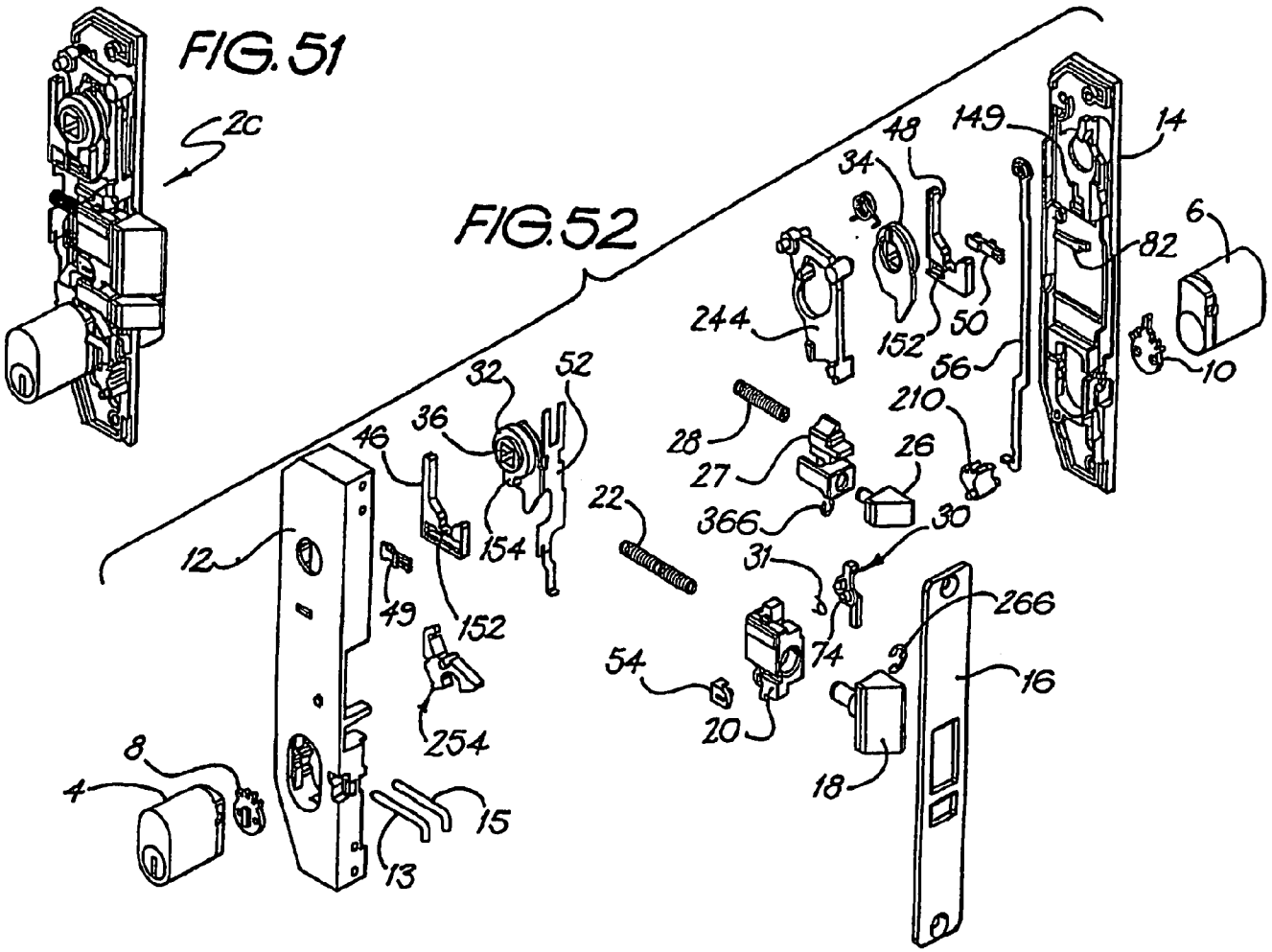
FIG. 51 is a front partial perspective view of the lock shown in FIG. 49.
FIG. 52 is an exploded perspective view of the lock shown in FIG. 51 in the orientation of FIG. 51.
Figure 54:
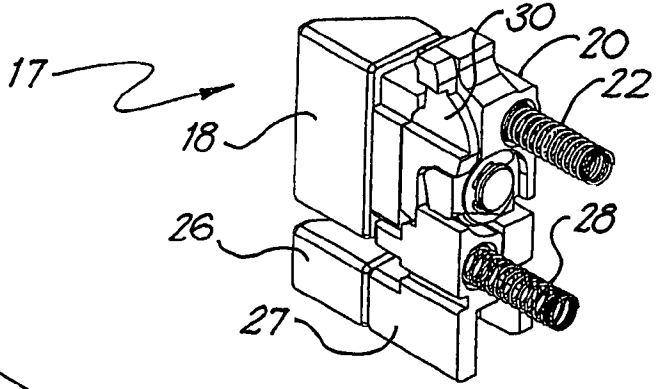
FIGS. 54 and 55 are assembled rear perspective views of the bolt assembly shown in FIG. 53 before and after door closure respectively.
Figure 55:
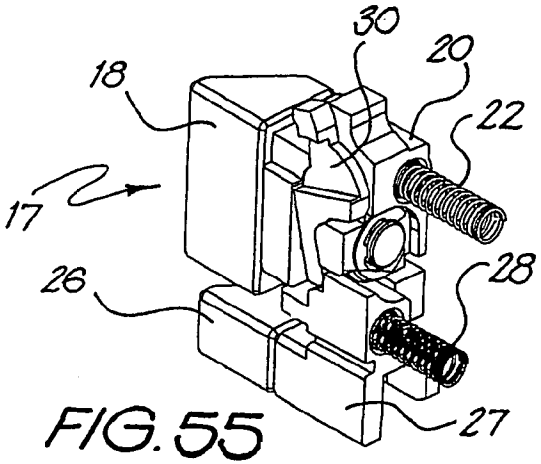

A more detailed explanation of the operation of the locking bar 52 will now be given with reference to FIGS. 41 to 48. As best seen in FIGS. 41 and 42, the locking bar 52 has a pair of upper recesses 142. Each of the first and second hub locking sliders 46, 48 have a slotted recess 143 which receives one of the locking bar engagers 49, 50 therein. The engagers 49, 50 have a slot 144 which is accessible through an opening 146 in the lock housing 12 and cover 14 respectively. A screw driver or like tool can be inserted into the openings 146 to set the engagers 49, 50 in an engaged position in which an end of the engagers 49, 50 is received within one of the slots 142 (see FIGS. 43 and 44) or a disengaged position in which the engagers 49, 50 do not enter the recess 142 (see FIGS. 45 and 46). The engager's 49, 50 are held in either of the engaged or disengaged positions by their other end engaging one of two detent slots 148 (see FIGS. 44 and 46) in the hub locking sliders 46, 48. The other end of the locking bar 52 has an angled tab 1148.

The engagers 49,50 each also have a protuberance 49*a*, 50*a* respectively, which are each received in a L-shaped recess 149 in each of the locking housing 12 and lock housing cover 14, as will be explained in more detail below.

Figure 23:
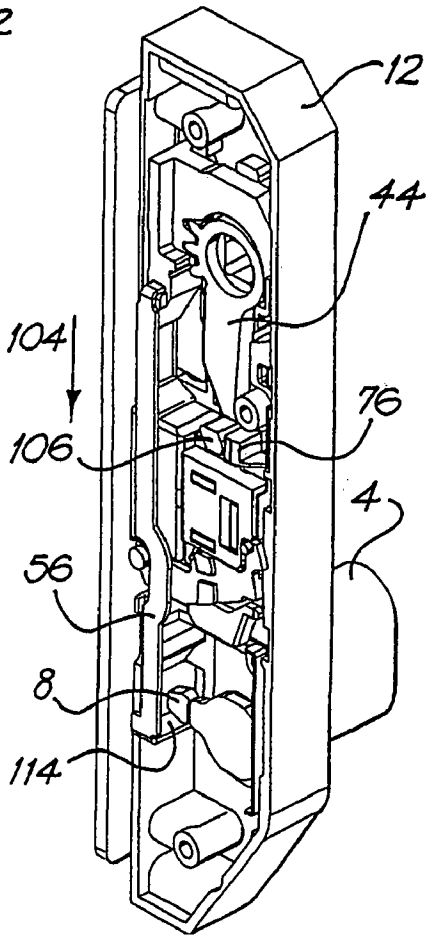

When the (short version) cylinder cam 8 is driven in the counter-clockwise direction past the position shown in FIG. 23, it initially abuts the angled tab 1148. Further anti-clockwise movement forces the locking bar 52 in the direction of arrow 150. If either of the locking bar engagers 49 and 50 are set in the engaged position (see FIGS. 43, 44 and 47) then such movement of the locking bar 52 will cause corresponding movement in the associated hub locking sliders 46, 48. During this movement, the engager's protuberances 49*a*, 50*a* travel within the longer arm of one of the L-shaped recesses 149. Each of the sliders 46, 48 also have a recess 152 which corresponds to the protuberance 154 on each of the hubs 32, 34 (see FIGS. 2 and 4). Accordingly, driving the locking bar 52 and any engaged hub locking sliders 46, 48 also drives the associated recess 152 over the protuberance 154 which prevents rotation of the hub 32, 34 and locking of the door. It is important to note that the engagers 49, 50 are independently settable so as to allow the lock operator to set from which side or both the door may be locked. It is also important to note that the hubs 32,34 operate in both turning directions and that the engagement of the recesses 152 and the protuberances 154 also locks the hubs 32,34 against rotation in both directions.

When either of the engagers 49, 50 is set to the disengaged position (see FIGS. 45, 46 and 48) then the key movement previously described will cause movement of the locking bar 52 in the direction 150 relative to the stationary hub locking slider 46 or 48. Accordingly, the recess 152 shall remain free of the protuberance 154 and allow movement of the associated hub 32, 34 and unlocking of the door from that side. In this position, the engager's protuberances 49*a*,50*a* each remain in the shorter arm of one of the L-shaped recesses 149.

The main advantage of this engager arrangement is that the engagers travel only as much as the locking bar and thus, in either position, do not add to the overall length of the locking bar and its associated components, as with known mortice locks. This reduces the space needed for the lock componentry and allows production of a smaller lock. Further, when the engagers 49,50 are set in the disengaged position, no movement is caused in the sliders 46,48 thereby reducing the number of moving parts in the lock 2*a* and associated friction.

FIGS. 49 to 92 show a second embodiment of a mortice lock 2*c* which includes examples of the five aspects of the invention. The lock 2*c* functions similar to the lock 2*a* and like reference numerals to those used in describing the lock 2*a* shall be used to indicate like or similar features with respect to the lock 2*c*.

Tuning firstly to FIGS. 49 to 53 the lock 2*c* includes first and second key cylinders 4 and 6 that each have associated cams 8 and 10. The first key cylinder 4 is mounted to a lock housing 12 by a pin 13 and a second key cylinder 6 is mounted to a lock housing cover 14 by a pin 15. A fore-end plate 16 is also mounted to the lock housing 12.

The lock 2*c* includes a bolt assembly 17 (see FIGS. 53 to 55) comprised of a latch bolt 18, a bolt carrier 20 with an associated bolt spring 22. The lock 2*c* also includes an auxiliary bolt assembly 226, with an auxiliary bolt 26 and an auxiliary bolt carrier 27, the latter being associated with an auxiliary bolt spring 28. A deadlocking member, in the form of deadlatching pivot arm 30, is pivotally mounted to the bolt assembly 17, more particularly to the bolt carrier 20 as will be described in more detail below. The pivot arm 30 has an associated torsion spring 31.

The lock 2*c* also includes external handles such as knobs or levers (not shown) which are connected to a pair of conventional square cross-section drive shafts (not shown) which are in turn connected to first and second hubs 32 and 34. More particularly, each of the hubs 32, 34 has a corresponding square cross-section aperture 36 for non-rotationally engaging each one of the drive shafts to transmit rotational movement from one of the handles to an associated one of the hubs 32, 34.

The lock 2*c* also includes a drive means and a bolt retraction assembly, that are incorporated into a latch bolt retraction member 244 as will also be described in more detail below.

The lock 2*c* also includes a pair of hub rotation locking means, in the form of first and second hub locking sliders 46 and 48, that each have an associated engagement means, in the form of first and second locking bar engagers 49 and 50. The locking bar engagers 49, 50 can each be set in one of two positions in which an associated hub locking slider 46 and 48 respectively does, or does not, travel with movement of a locking bar 52, as will also be described in more detail below.

The lock 2*c* also includes a kick-off actuation member, in the form of kick-off block 54, a cam pivot link 254 and a cylinder cam bolt retraction bar 56, the operation of which will also be described in more detail below.

Figure 53:
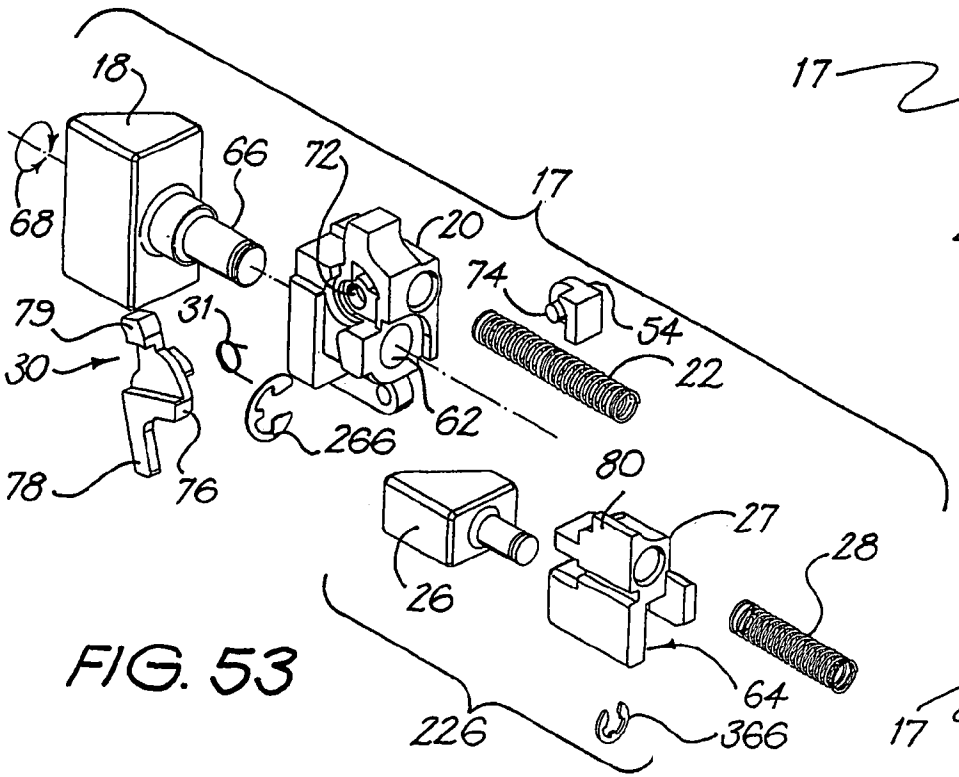
FIG. 53 is an exploded perspective view of a bolt assembly from the lock of FIG. 49.
Figure 57:
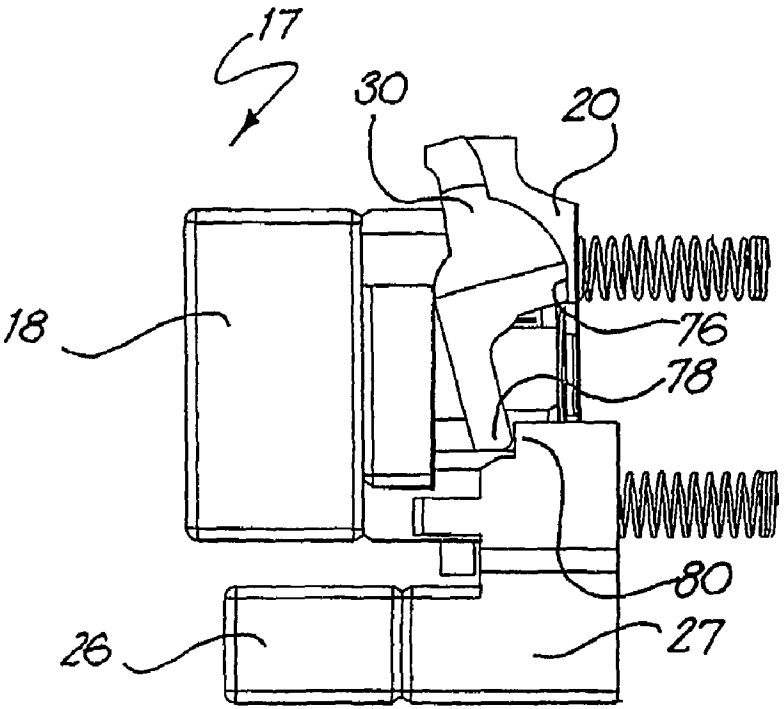
FIGS. 56 and 57 are side views of the bolt assembly shown in FIGS. 54 and 55 respectively.
Figure 56:
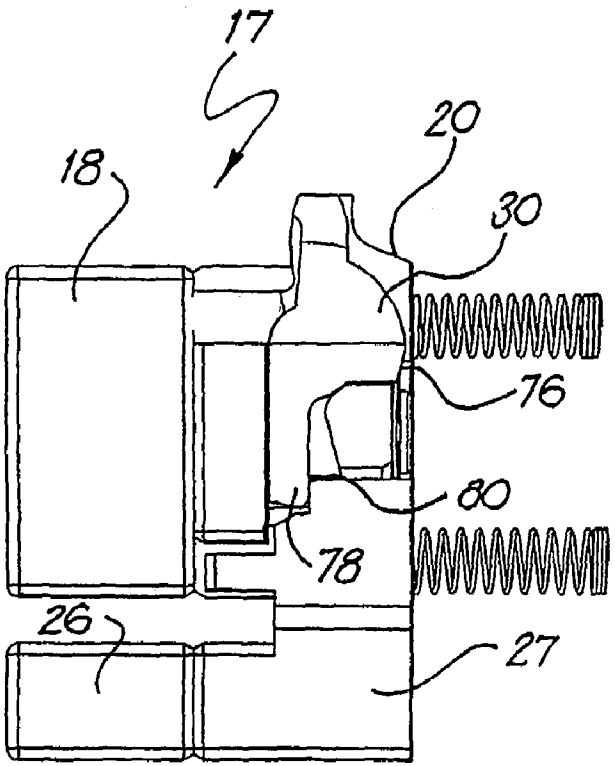

The features and operation of the deadlatching assembly will now be described in more detail with reference to FIGS. 53 to 63. As best seen in FIG. 53, the bolt carrier 20 includes a cylindrical recess 62 which corresponds to, and receives therein, a similar shaft 66 extending from the latch bolt 18. The latch bolt 18 is retained adjacent the carrier 20 by a circlip 266. The auxiliary latch bolt 26 is retained adjacent the auxiliary bolt carrier 27 by a circlip 366. This allows the latch bolt 18 and the auxiliary latch bolt 26 to be rotated about their longitudinal axes, as indicated by the double headed arrow 68, for easy re-handing of the lock 2*c*. The carrier 20 has another cylindrical recess 72 which corresponds to cylindrical portion 74 (see FIG. 52) on the dead latching pivot arm 30. This allows the pivot arm 30 to pivot between a deadlatching position (see FIG. 54, 55, 57, 58 and 59) and an opening position (see FIGS. 54, 60 and 61). The pivot arm 30 is biased to the deadlatching position by the torsion spring 31. The pivot arm 30 also has first, second and third protuberances 76, 78 and 79 respectively. The protuberance 78 operatively engages with a protuberance 80 on the auxiliary bolt carrier 27.

FIGS. 58 and 59 show the latch bolt 18 in an extended position, as would occur after closure of a door. During a slam door closing action, the bolt 18 initially retracts as it travels over a strikeplate (not shown) and then it extends under the influence of the spring 22 into the latch bolt opening present in a conventional strikeplate. As the strikeplate does not have an opening that corresponds to the auxiliary bolt 26, the auxiliary bolt 26 is not able to extend as far as a latch bolt 18 when the door is closed. This results in the protuberance 80 abutting, and causing pivotal movement of, the second protuberance 78 of the pivot arm 30, as described above. This pivotal movement of the pivot arm 30 causes the first protuberance 76 to pivot to the position shown in FIG. 58 and 59. As best shown in FIG. 59, when the pivot arm 30 is in this position the first protuberance 76 abuts a boss 82 on the cover plate 14 when the bolt is attempted to be forced back into the housing 12, in the direction of arrow 84. Such movement of the bolt 18 is as would be experienced if an illegal opening of the lock 2*c* was attempted. The boss 82 stops the latch bolt 18 from being retracted and thus stops the door from being opened.

FIGS. 60 and 61 show the lock 2*c* before door closure. As the auxiliary bolt 26 is able to extend to the same extent as the latch bolt 18, the protuberance 80 abuts, and causes pivotable movement of, the second protuberance 78 of the rocker arm 30 against the influence of the spring 31. This pivotable movement of the rocker arm 30 causes the first protuberance 76 to pivot to the position shown in FIGS. 60 and 61. As best shown in FIG. 61, when the rocker arm 30 is in this position the first end protuberance 76 clears the boss 82 on the cover plate 14 as the bolt 18 is forced back into the housing 12, in the direction of arrow 84. Such movement of the bolt 18 is as would be experienced during a slam door closure.

Figure 63:
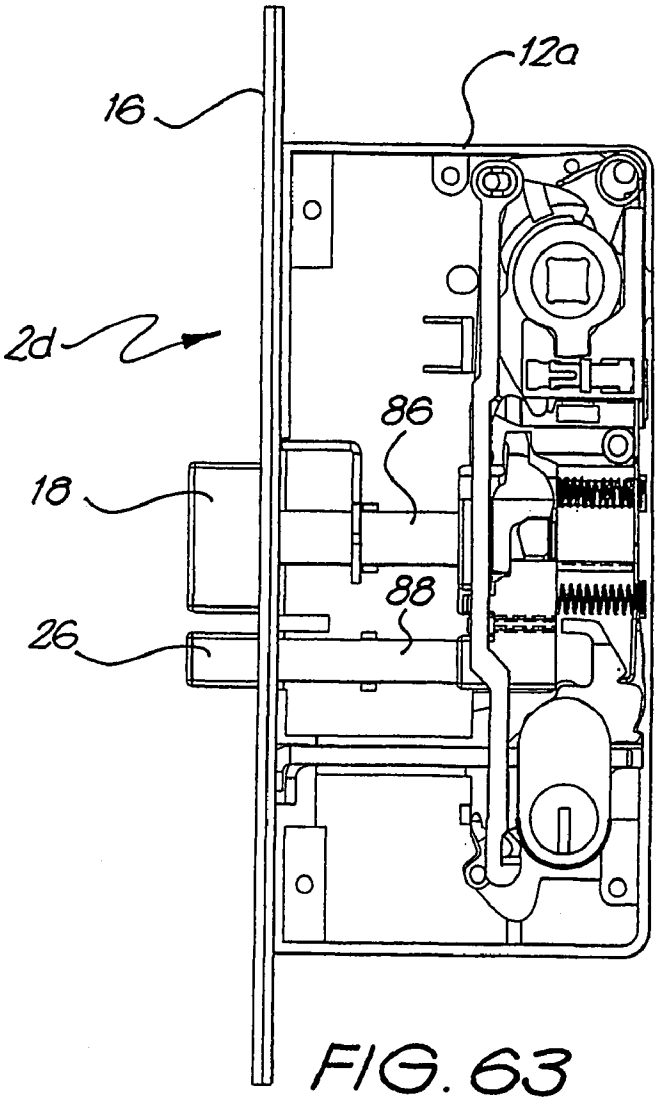
FIG. 63 is a modified form of the lock assembly shown in FIG. 62 with a 60 mm backset.
Figure 62:
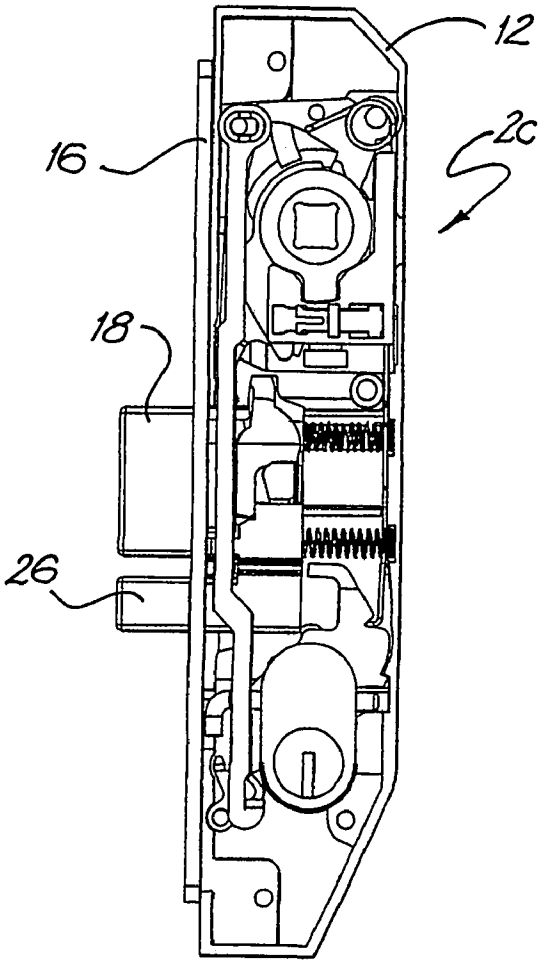
FIG. 62 is side a view of the lock shown in FIG. 49 with a 23 mm backset.

The primary advantage of the deadlatching pivot arm 30 being pivotally mounted to the bolt assembly 17 is best described with reference to FIGS. 62 and 63. FIG. 62 shows the lock 2*c* configured for a (standard) 23 mm backset. A 23 mm backset is suitable for an aluminium frame door. FIG. 63 shows an almost identical lock 2*d* configured for use with a (standard) 60 mm backset which is suitable for a standard timber door. Importantly, such a change can be simply achieved by the addition of two very simple extension pieces 86 and 88 to the bolt 18 and the auxiliary bolt 26 respectively, and the use of an extended housing 12*a* Alternatively, longer versions (not shown) of the bolt 18 and auxiliary bolt 26 can be substituted. All other components of the lock 2*c* remain unmodified. Accordingly, the lock 2*c* can be easily configured for many different backsets with only very minimal componentry changes, thereby obviating the need for specific lock designs for specific applications and reducing development and inventory costs.

Figure 66:
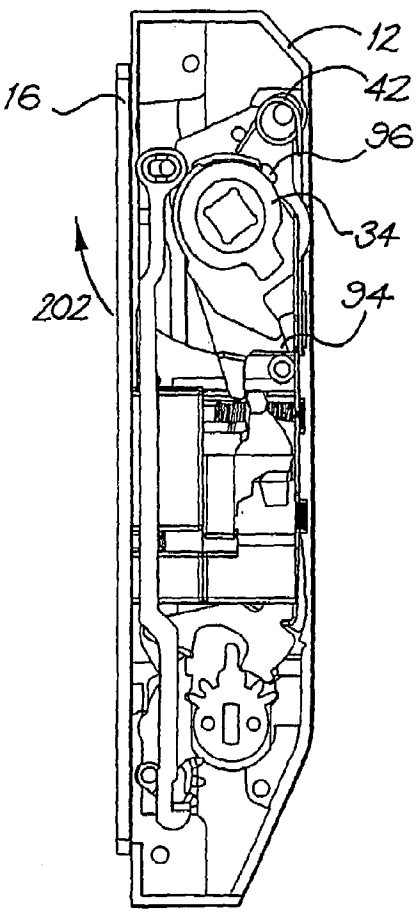
FIGS. 64, 65 and 66 are side views of the lock shown in FIG. 49 showing hub operation.
Figure 65:
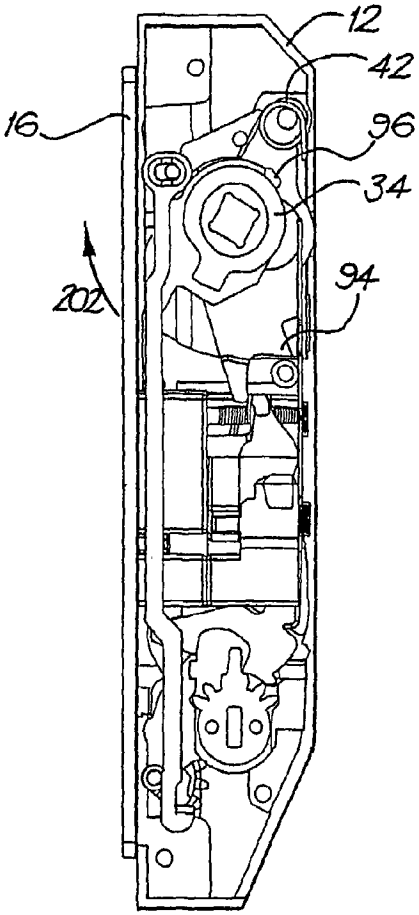
Figure 64:
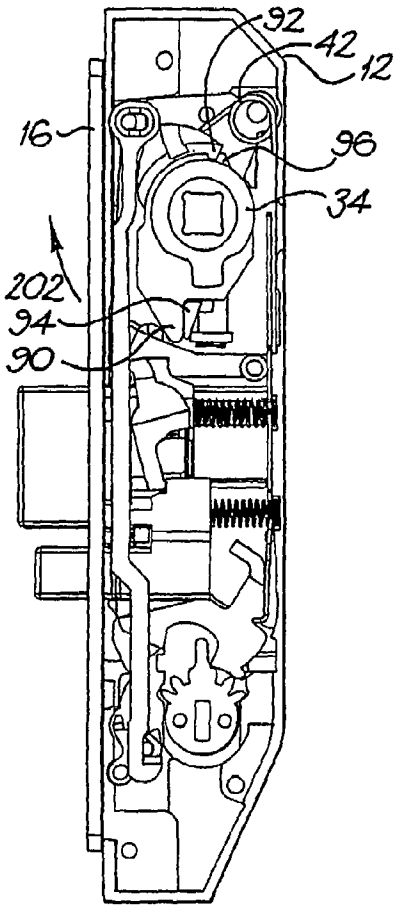

Also advantageous is that the bolt 18 in the lock 2*c* is able to be retracted, for door opening, by rotation of either exterior handle in either direction, as will now be described with reference to FIGS. 64 to 70. As best seen in FIGS. 64 to 66, the hub 34 has a pair of angularly spaced apart protuberances 90 and 92 and the latch bolt retraction member 244 has a pair of corresponding formations 94 and 96. The latch bolt retraction member 244 is biased in the direction of arrow 202 by the spring 42, which in turn biases the hub 34 into the (first position) shown in FIG. 64.

If the exterior handle (not shown) is turned to rotate the hub anticlockwise, as shown in FIG. 66, the first protuberance 90 engages the first formation 94 and pivots the latch bolt retraction member 244 in the opposite direction of arrow 202 and against the action of the spring 42 as the retraction arm 244. If the exterior handle (not shown) is turned to rotate the hub 34 in a clockwise direction, as shown in FIG. 65, the second protuberance 92 engages the second formation 96 which also causes counter clockwise pivotal movement of the retraction arm 244, as previously described.

Figure 67:
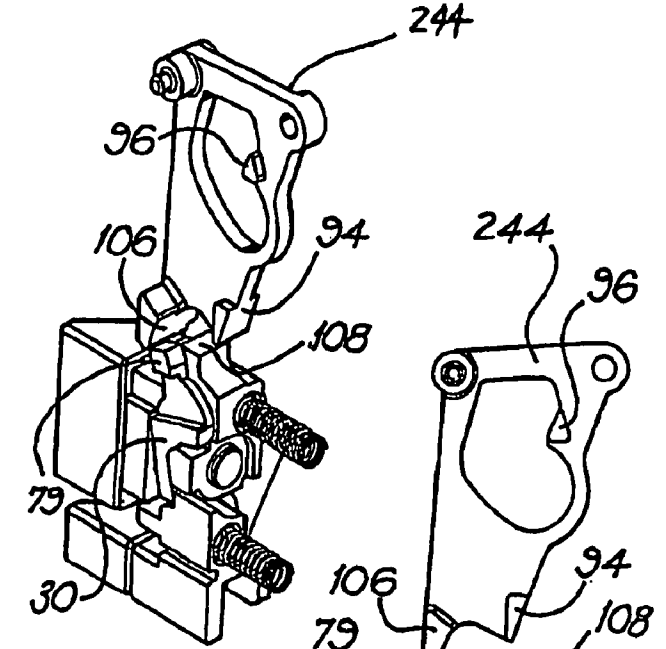
FIGS. 67 and 68 are partial perspective and side views respectively of the bolt assembly and a bolt retraction arm showing the bolt in an extended position.
Figure 68:
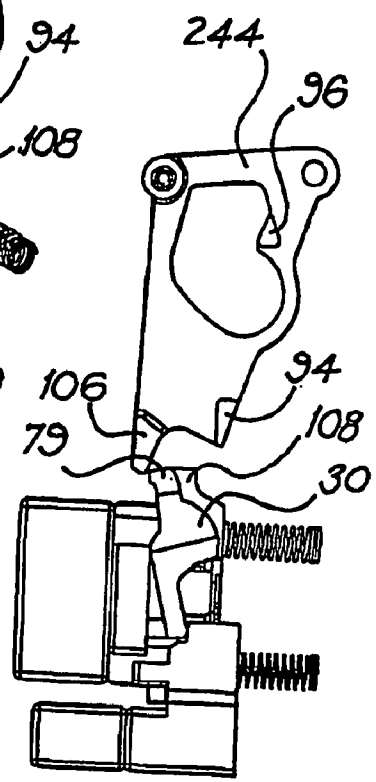
Figure 69:
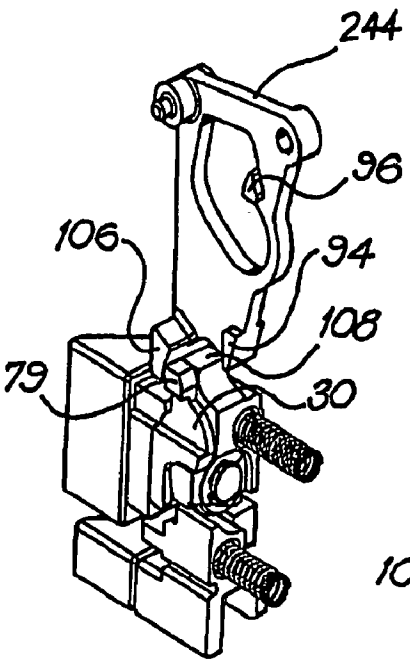
FIGS. 69 and 70 are partial perspective and side views respectively of a bolt assembly and a bolt retraction arm showing the bolt at the start of bolt retraction.
Figure 70:
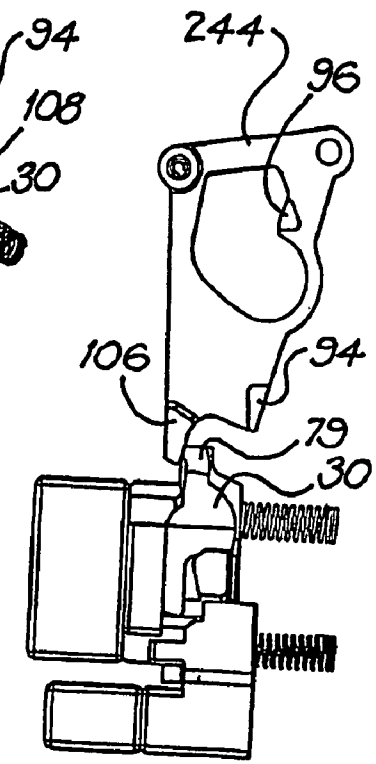

The retraction of latch bolt 18 by the latch bolt retraction arm 44 will now be described with reference to FIGS. 67 to 70. FIGS. 67 and 68 show the latch bolt 18 in an extended and deadlatched position. As has been previously described, the initial pivotal movement of the rocker arm 244 causes its distal end 106 to abut the third protuberance 79 of the deadlatching pivot arm 30 and drive the pivot arm 30 from the deadlatching position to an opening position. As the pivot arm 30 is moved to the opening position, the distal end of the retraction arm 244 also abuts a boss 108 provided on the bolt carrier 20 and further anticlockwise pivotal movement (see FIGS. 69 and 70) of the retraction arm 244 retracts the latch bolt 18 into the bolt casing 12.

It is advantageous for bolt retraction to be achievable with handle rotation in either direction, especially when the actuation handles are knobs. Further, when this handle operation is coupled with the re-handing ability of the latch bolt described above then a single lock is provided that is suitable for use in all installations regardless of inside/outside/left hand opening/right hand opening.

Figure 73:
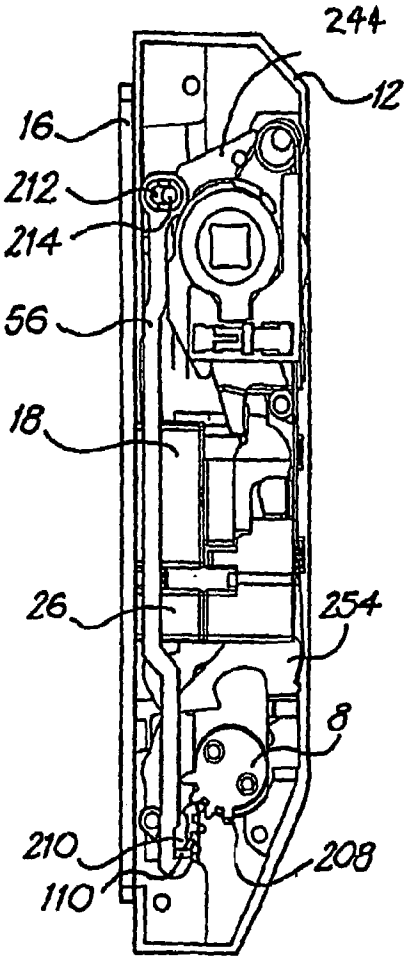
FIGS. 71, 72, and 73 are side views of the lock shown in FIG. 49 showing bolt retraction with a short cam.
Figure 72:
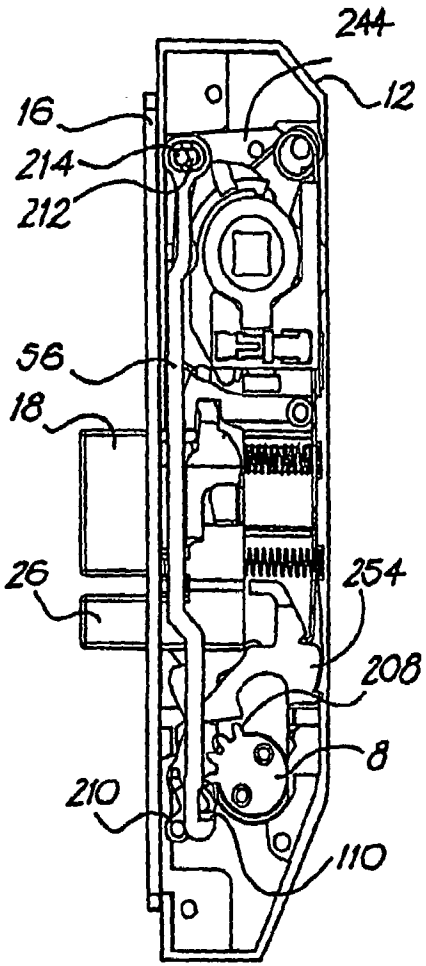
Figure 71:
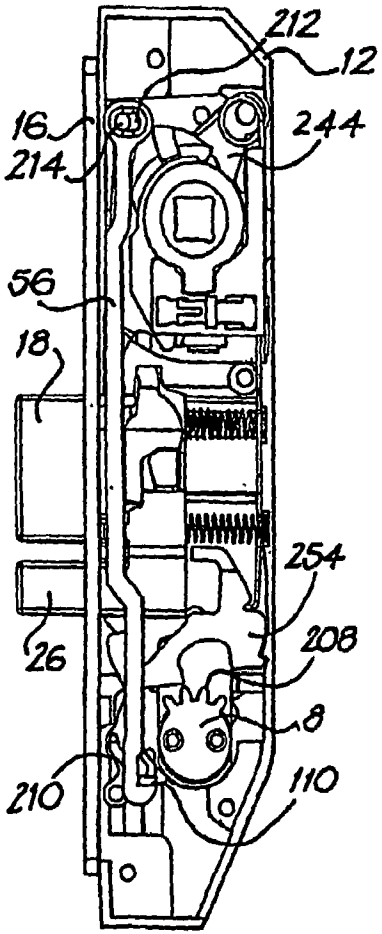

The operation of the retraction bar 56 will now be described with reference to FIGS. 71 to 73, which show the lock 2*c* with a "short" version of the cam 8 that has external gears 208. The bar 56 has a first end tab 110 which engages a camming member 210 which is pivotally mounted to the lock cover 14. The other end of the bar 56 has an opening 212 which engages with a spigot 214 provided on the retraction member 44. When a key is inserted to the cylinder 4 and rotated, corresponding rotation is caused in the cam 8 which causes it to initially engage the cam member 210 (see FIG. 72). Continued rotation of the cam 8 causes the cam member 210 to rotate to the position shown in FIG. 73 which causes corresponding downward movement in the retraction bar 56. This movement of the retraction bar 56 causes the retraction member 244 to pivot in an anticlockwise direction such that the distal end 106 of the retraction arm 244 abuts the boss 108 provided on the bolt carrier 20 and retracts the latch bolt 18 into the bolt casing 12, in the manner previously described. The movement of the cam 8 does not influence the position of the cam pivot link 254. Accordingly, the short cam is only able to retract the latch bolt. It cannot lock or unlock the locking bar.

The advantages of the short cam arrangement is the key cylinder cams 8 and 10 have a common component to that of the handle the overall number of components in the lock 2*c* is reduced thereby simplifying manufacture and assembly.

Figures 74, 75, 76, 77:
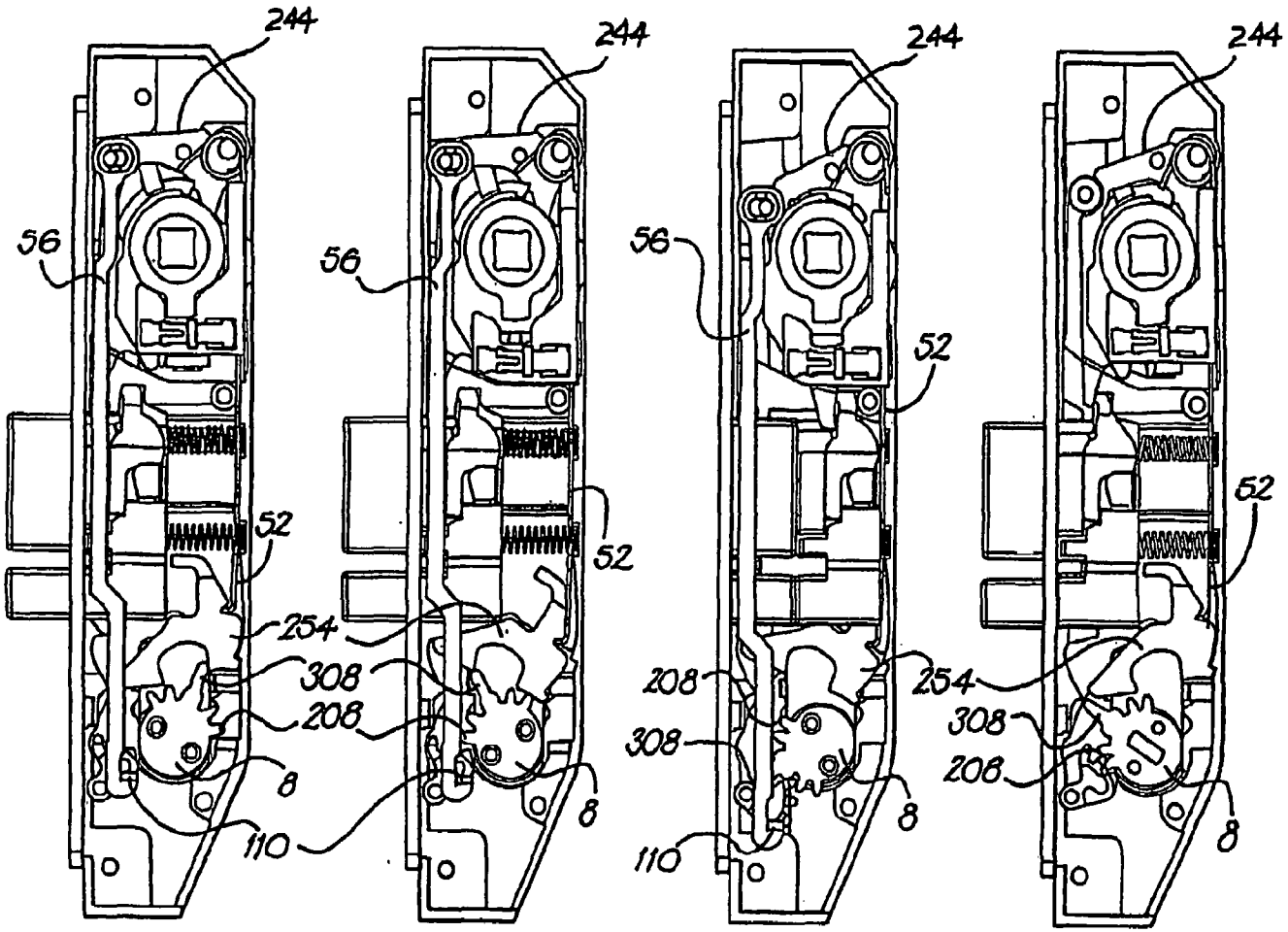
FIGS. 74, 75, 76 and 77 are side views of the lock shown in FIG. 49 showing bolt retraction and locking bar operation with a medium cam.

The operation of the locking bar 52 and the retraction bar 56 will now be described with reference to FIGS. 74 to 77, which show the lock 2*c* with a "medium" version of the cam 8 that has external gears 208 and a medium length finger 308. FIG. 74 shows the finger 308 rotated to a position that pivots the cam pivot link 254 anti-clockwise. This causes upward movement in the locking bar 52 that results in the lock 2*c* being locked, as will be described below. FIG. 75 shows the finger 308 rotated to a position that pivots the cam pivot link 254 clockwise. This causes downward movement in the locking bar 52 that results in the lock 2*c* being unlocked, as will be described below. FIG. 76 shows the finger 308 further rotated to a position that pivots the cam 8 such that the gears 208 initially engage the cam member 210. Continued rotation of the cam 8 causes the cam member 210 to rotate to the position shown in FIG. 77 which causes corresponding downward movement in the retraction bar 56. This movement of the retraction bar 56 causes the retraction member 244 to pivot in an anticlockwise direction such that the distal end 106 of the retraction arm 244 abuts the boss 108 provided on the bolt carrier 20 and retracts the latch bolt 18 into the bolt casing 12, in the manner previously described.

The advantages of the medium cam arrangement are two-fold. Firstly, regardless if the lock is locked or unlocked a closed door can be operated single handedly (ie. if unlocked—turn only key or turn only handle, if locked—turn only key). Secondly, as the key cylinder cams 8 and 10 have a common component to that of the handle the overall number of components in the lock 2*c* is reduced thereby simplifying manufacture and assembly.

Figure 80:
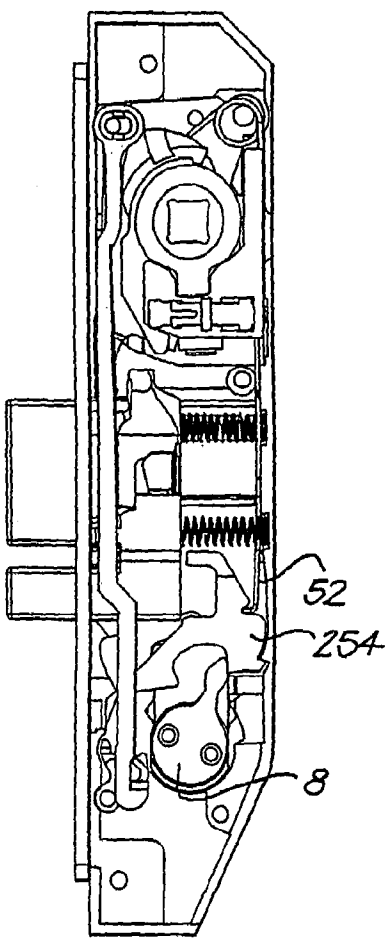
FIGS. 78, 79 and 80 are side views of the, lock shown in FIG. 49 showing locking bar operation with a long cam.
Figure 79:
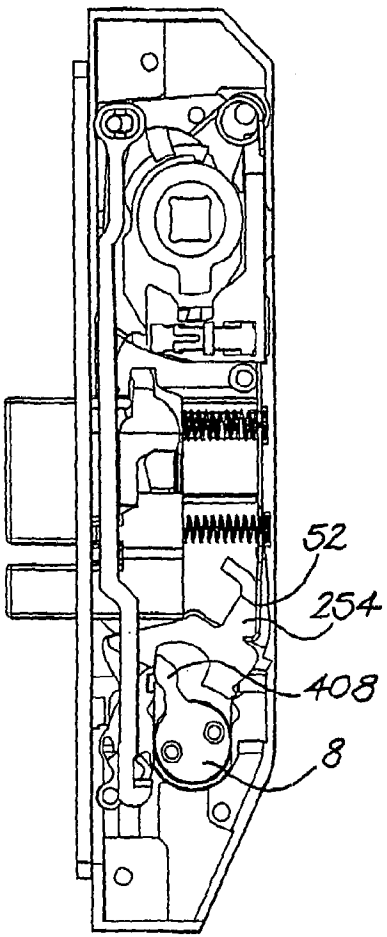
Figure 78:
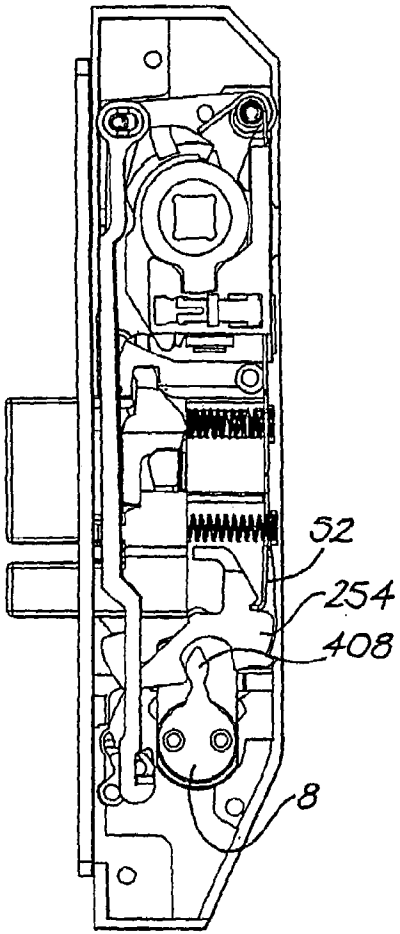

The operation of the locking bar 52 will now be described with reference to FIGS. 78 to 80, which show the lock 2*c* with a "long" version of the cam 8 that has long length finger 408. FIG. 78 shows the finger 408 in a neutral position where it does not engage the cam pivot link 254. FIG. 79 shows the finger 408 rotated to a position that pivots the cam pivot link 254 clockwise. This causes downward movement in the locking bar 52 that results in the lock 2*c* being unlocked, as will be described below. FIG. 80 shows the finger 408 rotated to a position that pivots the cam pivot link 254 anti-clockwise. This causes upward movement in the locking bar 52 that results in the lock 2*c* being locked, as will be described below. Accordingly, the long cam 8 is only able to lock or unlock the locking bar. It cannot retract the latch bolt.

The advantages of the long cam arrangement is, as the key cylinder cams 8 and 10 have a common component to that of the handle, the overall number of components in the lock 2*c* is reduced thereby simplifying manufacture and assembly.

By configuring each side of the lock 2*c* with appropriate short, medium or long cams, the lock 2*c* can be customised for different applications and access requirements.

Figure 84:
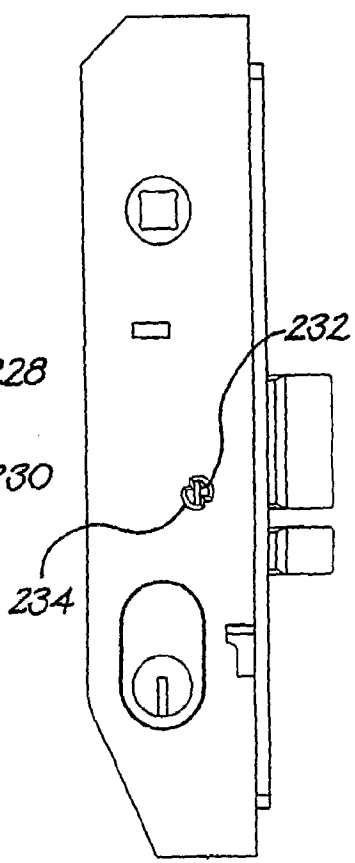
FIGS. 83 and 84 are partial and complete side views of the lock shown in FIG. 49 configured with an active kick-off.
Figure 83:
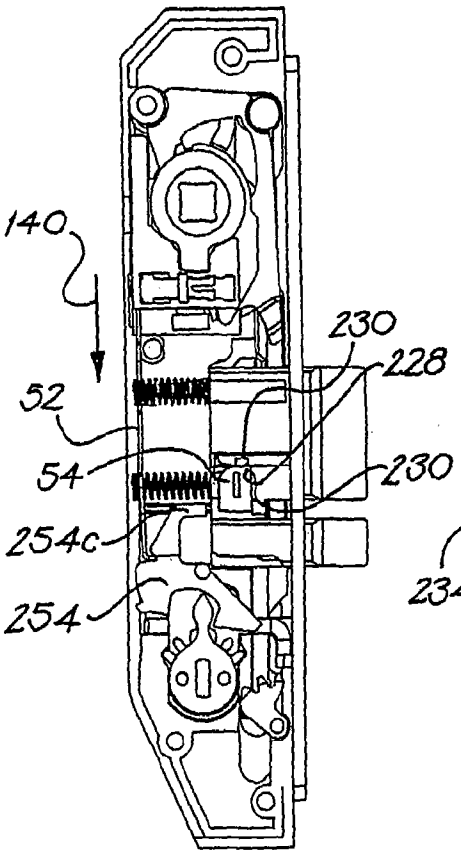
Figure 82:
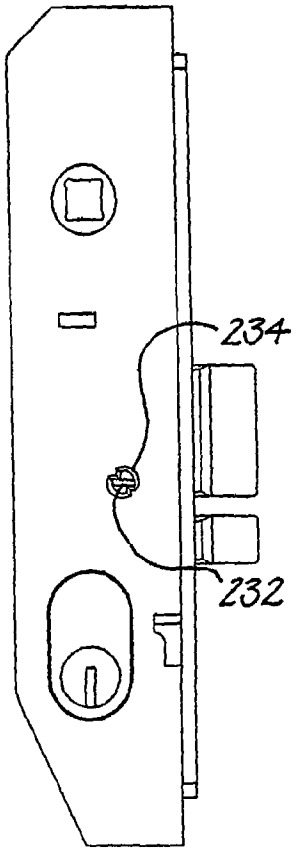
FIGS. 81 and 82 are partial and complete side views respectively of the lock shown in FIG. 49 configured with an inactive kick-off.
Figure 81:
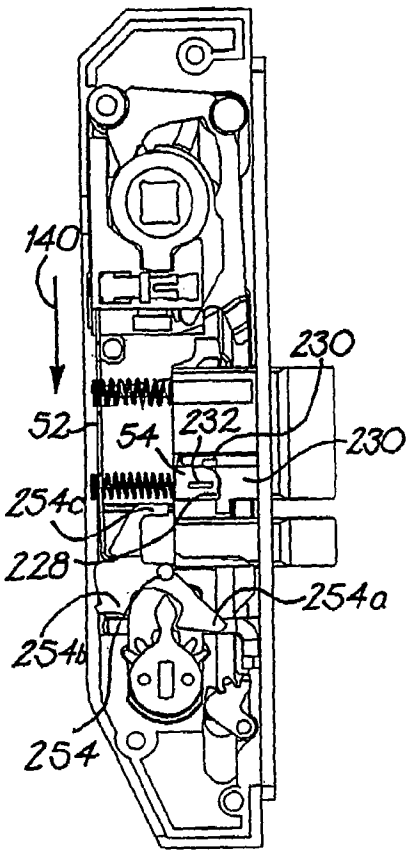
Figure 86:
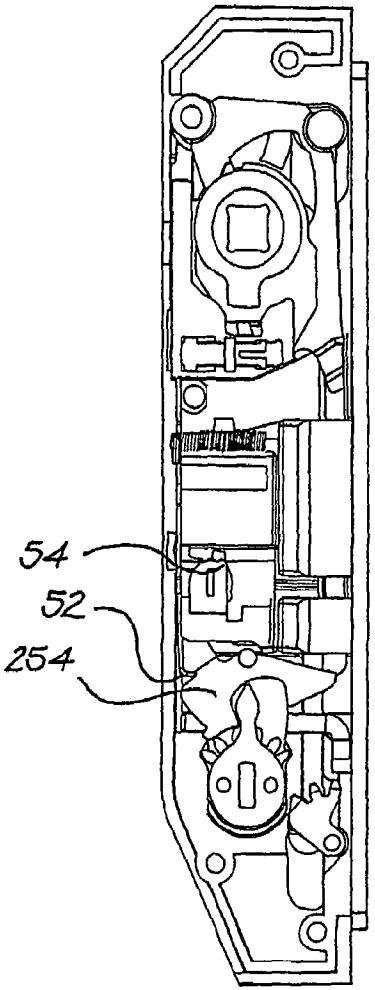
FIGS. 85 and 86 are partial side views of the lock shown in FIG. 49 showing pre and post kick-off operation respectively.
Figure 85:
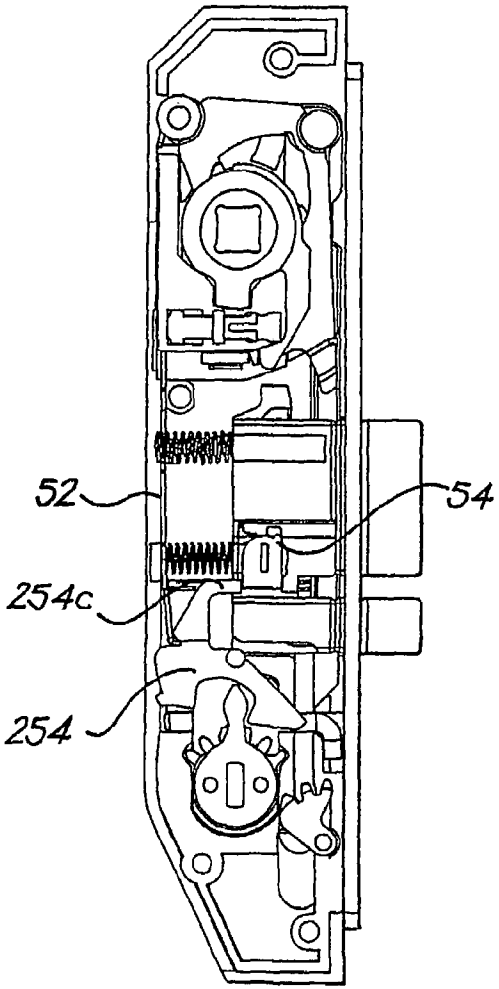

The operation of the kick-off block 54 will now be described in more detail with reference to FIGS. 81 to 84. The block 54 pivots about shaft 74, which is received within a corresponding recess in the bolt carrier 20. The block 54 has a detent 228 which engages one of two corresponding detents 230 in the bolt carrier 20. The block also includes a slot 232 which, after assembly, is accessible through an opening 234 (see FIGS. 82 and 84) in the lock cover housing 14. A screwdriver or like took can be inserted through the opening 234 into the slot 232 and used to position the kick-off block 54 in an inactive position (as shown in FIGS. 81 and 82) or an active position (as shown in FIGS. 83 and 84). The cam pivot link 254 has three portions 254*a*, 254*b* and 254*c*. The portion 254*c* is positioned towards the kick-off block 54 and is also engaged with the locking bar 52. The locking bar 52 can be linked for movement with the first and second hub-locking sliders 46 and 50 for locking and unlocking the lock 2*c*, as will be described in more detail below. For present purposes is sufficient to say that driving the locking bar 52 in the direction of arrow 140 can unlock the lock 2*c*.

FIGS. 81 and 82 show the kick-off block 54 in the inactive position. During closure of the door, the bolt 18 rides over the strikeplate and is moved from an extended position to a retracted position. During this movement the kick-off block 54 slides over the cam pivot link portion 254*c* without any driving contact being made therebetween. Accordingly, this movement does not affect the position of the kick-off block 54 or the cam pivot link 254 or the locking bar 52. Therefore, when the kick-off lever 54 is in the inactive position, closure of the door will not unlock the lock 2*c*.

When the kick-off block 54 is in the active position (see FIGS. 83 to 84) then closing of the door as previously described causes the drive block to contact the cam pivot link portion 254*c*. Further retraction of the bolt 18 results in the cam pivot link 254 being pivoted in an anticlockwise direction to position shown in FIG. 86. This causes the locking bar 52 to be driven in the direction of arrow 140, thereby altering the lock 2*c* from locked to unlocked.

Placing the kick off block 54 in the active position therefore provides a safe guard against inadvertent locking of the door upon closure. An advantage provided by the kick off block 54 is that it operates in conjunction with components of the lock used for other purposes (ie. the locking bar and the cam pivot link) thereby reducing the number of components and the production and assembly cost of the lock overall.

Figure 88:
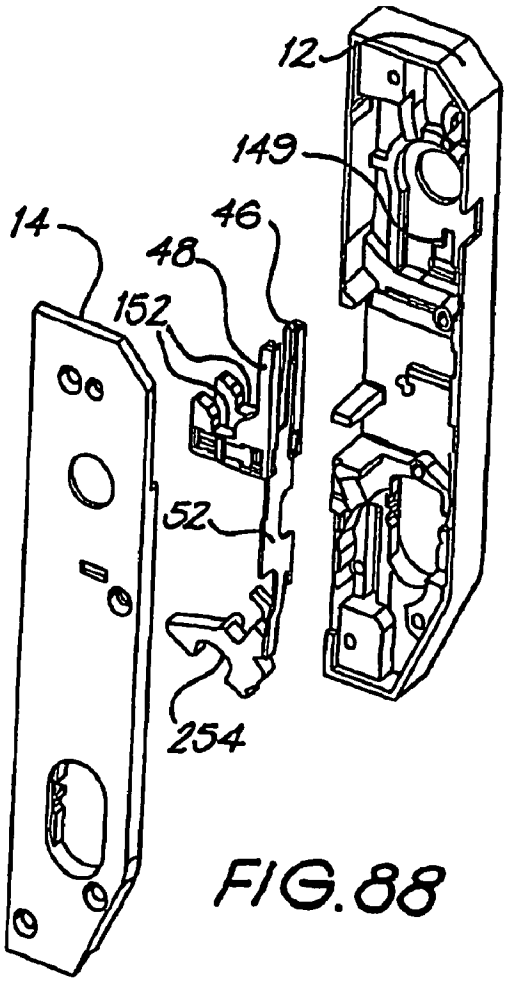
FIGS. 87 and 88 are exploded and assembled perspective views of the hub locking means from the lock of FIG. 49.
Figure 87:
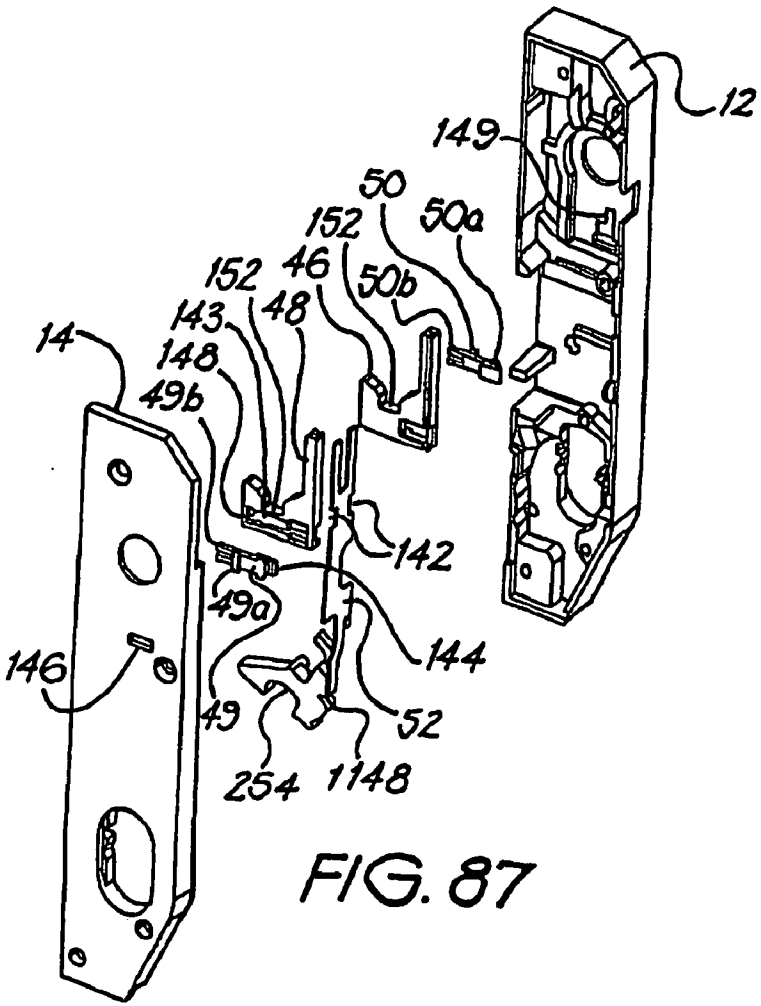

A more detailed explanation of the operation of the locking bar 52 will now be given with reference to FIGS. 87 to 92. As best seen in FIGS. 87 and 88, the locking bar 52 has a pair of upper recesses 142. Each of the first and second hub locking sliders 46, 48 have a slotted recess 143 which receives one of the locking bar engagers 49, 50 therein. The engagers 49, 50 have a tab 144 which is accessible through an opening 146 in the lock housing 12 and cover 14 respectively. A screw driver or like tool can be inserted into the openings 146 and push the tab 144 to set the engagers 49, 50 in an engaged position in which an end of the engagers 49, 50 is received within one of the slots 142 (see FIGS. 89 and 90) or a disengaged position in which the engagers 49, 50 do not enter the recess 142 (see FIGS. 91 and 92). The engagers 49, 50 are held in either of the engaged or disengaged positions by legs 49*b* and 50*b* engaging one of two detent slots 148 (see FIGS. 90 and 92) in the hub locking sliders 46, 48. The other end of the locking bar 52 has an angled tab 1148, which engages a complimentary slot in the cam pivot link 254.

The engagers 49,50 each also have a protuberance 49*a*, 50*a* respectively, which are each received in a L-shaped recess 149 in each of the locking housing 12 and lock housing cover 14, as will be explained in more detail below.

When the pivot cam link 254 is driven anti-clockwise, as described above, the locking bar 52 (which is connected thereto) is forced in the direction of arrow 150. If either of the locking bar engagers 49 and 50 are set in the engaged position (see FIGS. 89 and 90) then such movement of the locking bar 52 will cause corresponding movement in the associated hub locking sliders 46,48. During this movement, the engager's protuberances 49*a*, 50*a* travel within the longer arm of one of the L-shaped recesses 149. Each of the sliders 46, 48 also have a recess 152 which corresponds to the protuberance 154 on each of the hubs 32, 34 (see FIGS. 50 and 52). Accordingly, driving the locking bar 52 and any engaged hub locking sliders 46, 48 also drives the associated recess 152 over the protuberance 154 which prevents rotation of the hub 32, 34 and locking of the door. It is important to note that the engagers 49, 50 are independently settable so as to allow the lock operator to set from which side or both the door may be locked. It is also important to note that the hubs 32,34 operate in both turning directions and that the engagement of the recesses 152 and the protuberances 154 also locks the hubs 32,34 against rotation in both directions.

When either of the engagers 49, 50 is set to the disengaged position (see FIGS. 91 and 92) then the movements previously described will cause movement of the locking bar 52 in the direction 150 relative to the stationary hub locking slider 46,48. Accordingly, the recess 152 shall remain free of the protuberance 154 and allow movement of the associated hub 32, 34 and unlocking of the door from that side. In this position, the engager's protuberances 49*a*,50*a* each remain in the shorter arm of one of the L-shaped recesses 149.

The main advantage of this engager arrangement is that the engagers travel only as much as the locking bar and thus, in either position, do not add to the overall length of the locking bar and its associated components, as with known mortice locks. This reduces the space needed for the lock componentry and allows production of a smaller lock. Further, when the engagers 49,50 are set in the disengaged position, no movement is caused in the sliders 46,48 thereby reducing the number of moving parts in the lock 2*c* and associated friction.

The embodiments of the locks described above possess many specific advantages arising from the numerous inventive aspects of particular componentry. However, the locks are also generally advantageous over those of the prior art due to their reduced componentry and simplicity.

Although the invention has been described with reference to a specific examples, it will be appreciated with those skilled in the art that the invention may be embodied in many other forms. Further, many components have only been described with reference to one side of the locks and the skilled person will also appreciate that the same components on the other side of the locks operate in a similar manner.

What is claimed is:

1. A mortice lock comprising:

a lock housing;

a bolt assembly adapted to move relative to the housing along a working direction between extended position and retracted positions;

a deadlatching member adapted to pivot between a deadlatching position preventing the bolt assembly from moving from the extended position to the retracted position and a closing position allowing the bolt assembly to move from the extended position to the retracted position, said deadlatching member being spring biased to the deadlatching position;

wherein the deadlatching member is pivotally mounted on the bolt assembly for movement with the bolt assembly and adapted to pivot between said deadlatching and closing positions in a direction normal to the working direction.

2. The lock as claimed in claim 1, wherein the bolt assembly is spring biased to the extended position.

3. The lock as claimed in claim 1, wherein the lock housing has a protuberance and, when in the closing position, the deadlatching member is adapted to travel with the bolt assembly past the protuberance and, when in the deadlatching position, the deadlatching member is adapted to travel with the bolt assembly into abutment with the protuberance.

4. The lock as claimed in claim 1, wherein the bolt assembly includes a primary bolt and an auxiliary bolt and the deadlatching member is driven between the closing and deadlatching positions by relative movement between the primary bolt and the auxiliary bolt.

5. The lock as claimed in claim 4, wherein the bolt assembly also includes a bolt carrier to which: the primary bolt is rotationally mounted; the deadlatching member is pivotally mounted; and the auxiliary bolt is slidably mounted.

6. The lock as claimed in claim 5, wherein the deadlatching member includes a first protuberance adapted to abut the auxiliary bolt, whereby slidable movement of the auxiliary bolt relative to the primary bolt causes pivotal movement of the deadlatching member.

7. The lock as claimed in claim 4, wherein the bolt assembly also includes a bolt carrier assembly to which: the primary bolt is rotationally mounted; the deadlatching member is pivotally mounted; and an auxiliary bolt assembly is slidably mounted.

8. The lock as claimed in claim 7, wherein the deadlatching member includes a protuberance adapted to abut the auxiliary bolt assembly, whereby slidable movement of the auxiliary bolt assembly relative to the bolt carrier assembly causes pivotal movement of the deadlatching member.

9. The lock as claimed in claim 8, wherein the auxiliary bolt assembly includes the auxiliary bolt and an auxiliary bolt carrier.

10. The lock as claimed in claim 1, wherein the lock also includes a drive shaft adapted to be driven about an axis by a handle or knob and a member adapted to pivot in response to rotation of said drive shaft, whereby initial pivotal movement of the member causes pivotal movement of the deadlatching member to the closing position and further pivotal movement of the deadlatching member causes sliding movement of the bolt assembly to the retracted position.

11. A mortice lock comprising:

a lock housing;

a drive shaft adapted to be rotationally driven about an axis by a handle or knob;

a hub mounted on the shaft for rotation therewith from a first position towards either a second clockwise position and a third anti-clockwise position, the hub having a pair of spaced apart protuberances; and a drive means adapted for movement relative to the housing, the drive means having a pair of formations and an engaging surface adapted, upon moving, to cause movement in a bolt retraction assembly, wherein clockwise movement of the hub to the second position causes one of the protuberances to abut one of the formations and cause the drive member to move in a first direction and anti-clockwise movement of the hub to the third position causes the other of the protuberances to abut the other of the formations and also cause the drive member to move in the first direction.

12. The lock as claimed in claim 11, wherein the drive means is mounted for slidable movement relative to the housing.

13. The lock as claimed in claim 11, wherein the drive means is mounted for pivotal movement relative to the housing and incorporates the bolt retraction assembly therein.

14. The lock as claimed in claim 11, wherein the bolt retraction assembly is moved to retract the bolt regardless of which direction (clockwise or anti-clockwise) the handle or knob is rotated.

15. The lock as claimed in claim 11, wherein the drive means is spring biased in a second direction opposite the first direction and also biases the hub to the first position.

16. The lock as claimed in claim 11, wherein the lock includes a pair of the drive shafts and a pair of the hubs, each mounted on one of the drive shafts, and the drive means contains two pairs of formations, wherein each one of the pairs of formations is adapted to engage each one of the pairs of protuberances when the hubs are in the first position.

17. The lock as claimed in claim 11, wherein the bolt retraction assembly includes a pivotable latch arm and the drive member engaging surface is a gear rack adapted to engage with a gear portion provided on the latch arm.

18. The lock as claimed in claim 11, wherein the bolt retraction assembly is an arm pivotally mounted to the lock housing.

19. A mortice lock comprising:

a lock housing;

a drive shaft adapted to be rotationally driven about an axis by a handle or knob;

a hub mounted on the shaft for rotation therewith, the hub having a protuberance; and a hub rotation locking means having a recess and adapted for slidable movement relative to the housing between a first position in which the protuberance is received within the recess and the hub is thus prevented from rotating and a second position in which the protuberance is remote the recess and the hub is thus able to rotate;

a locking device adapted for slidable movement relative to the housing in response to rotation of a cylinder cam;

an engagement means settable in an engaged position in which the hub rotation locking means and the locking device are joined for slidable movement together relative to the housing and a disengaged position in which the hub rotation locking means and the locking device are free from slidable movement together relative to the housing, wherein, when the hub locking means is in the second position and said engagement means is set in said engaged position, rotation of the cylinder cam in a first direction slides the locking device and the hub rotation locking means together such that the protuberance is received in the recess and the hub is not able to rotate and, when the hub locking means is in the second position and said engagement means is set in the disengaged position, rotation of the cylinder cam in said first direction slides the locking device only such that the protuberance remains remote from the recess and the hub is able to rotate.

20. The lock as claimed in claim 19, wherein when the hub locking means is in the first position and the engagement means is set in the engaged position, rotation of the cylinder cam in a second direction opposite to the first direction slides the locking device and the hub rotation locking means together such that the protuberance is remote from the recess and the hub is able to rotate.

21. The lock as claimed in claim 19, wherein the engagement means travels between the engaged and disengaged positions in a direction normal to the direction of travel of the locking device.

22. The lock as claimed in claim 19, wherein the engagement means includes an end that is received with an opening in the locking device in the engaged position and that is remote the opening in the disengaged position.

23. The lock as claimed in claim 19, wherein the engagement means is biased to remain in one of the engaged or disengaged positions by a detent.

24. The lock as claimed in claim 19, wherein the engagement means is biased to remain in one of the engaged or disengaged positions by spring legs.

25. The lock as claimed in claim 19, wherein the lock includes a pair of the drive shafts and a pair of the hubs, each mounted on one of the drive shafts, and a pair of the engagement means, wherein each of the engagement means are independently settable with respect to the locking device.

26. A mortice lock comprising:

a lock housing;

a bolt assembly adapted to move relative to the housing between extended and retracted positions, the bolt assembly having a first driving protuberance;

a kick off actuation member mounted for pivotal movement between an active position and an inactive position, the kick off member having a second driving protuberance;

a hub mounted on a drive shaft for rotation therewith; and a locking device adapted for slidable movement relative to the housing between a locking position preventing rotation of the hub and an unlocking position allowing rotation of the hub;

wherein when the kick off member is in the inactive position and the bolt assembly is driven from the extended position towards the retracted position, the first driving protuberance passes the second driving protuberance without contact therebetween and causes no movement of the kick off member from the inactive position, and wherein when the kick off member is in the active position and the bolt assembly is driven from the extended position towards the retracted position, the first driving protuberance contacts the second driving protuberance and causes initial pivotal movement of the kick off member to the active position and further pivotal movement of the kick off member in the same direction causing the locking device to be driven to the locking position.

27. The lock as claimed in claim 26, wherein the kick off member is biased to remain in one of the active or inactive positions by a detent.

28. The lock as claimed in claim 26, wherein the kick off member is pivotally mounted to the casing.

29. The lock as claimed in claim 26, wherein the kick off member is pivotally mounted to the bolt assembly.

30. The lock as claimed in claim 26, wherein the lock housing includes an aperture through which a tool end may pass into engagement with the kick off member to allow movement of the kick off member between the active or inactive positions.

31. A mortice lock comprising:

a lock housing;

a bolt assembly adapted to move relative to the housing along a working direction between extended position and retracted positions, said bolt assembly being spring biased to the extended position;

a deadlatching member adapted to pivot between a deadlatching position preventing the bolt assembly from moving from the extended position to the retracted position and a closing position allowing the bolt assembly to move from the extended position to the retracted position;

wherein the deadlatching member is pivotally mounted on the bolt assembly for movement with the bolt assembly and adapted to pivot between said deadlatching and closing positions in a direction normal to the working direction.

32. A mortice lock comprising:

a lock housing;

a bolt assembly adapted to move relative to the housing along a working direction between extended position and retracted positions, said bolt assembly including a primary bolt and an auxiliary bolt;

a deadlatching member adapted to pivot between a deadlatching position preventing the bolt assembly from moving from the extended position to the retracted position and a closing position allowing the bolt assembly to move from the extended position to the retracted position, said deadlatching member being driven between the closing and deadlatching positions by relative movement between the primary bolt and the auxiliary bolt;

wherein the deadlatching member is pivotally mounted on the bolt assembly for movement with the bolt assembly and adapted to pivot between said deadlatching and closing positions in a direction normal to the working direction.

* * * * *